US012742315B2

(12) United States Patent
Kiyama et al.

(10) Patent No.: US 12,742,315 B2
(45) Date of Patent: Sep. 22, 2026

(54) EXCAVATING ASSEMBLY SYSTEM WITH COLLARED FASTENING SYSTEM

(71) Applicant: Hensley Industries, Inc., Dallas, TX (US)

(72) Inventors: Yusuke Kiyama, Ibaraki-ken (JP); Mohamad Youssef Bilal, Little Elm, TX (US); Sean M. Pitts, Mesquite, TX (US)

(73) Assignee: Hensley Industries, Inc., Dallas, TX (US)

( * ) Notice: Subject to any disclaimer, the term of this patent is extended or adjusted under 35 U.S.C. 154(b) by 599 days.

(21) Appl. No.: 18/190,785

(22) Filed: Mar. 27, 2023

(65) Prior Publication Data

US 2023/0323641 A1 Oct. 12, 2023

Related U.S. Application Data

(60) Provisional application No. 63/329,807, filed on Apr. 11, 2022.

(51) Int. Cl.
*E02F 9/28* (2006.01)

(52) U.S. Cl.
CPC ..... *E02F 9/2883* (2013.01)

(58) Field of Classification Search
CPC ..... E02F 3/8152; E02F 3/8155; E02F 9/2883; E02F 9/2841; E02F 9/2833; E02F 9/2825
See application file for complete search history.

(56) References Cited

U.S. PATENT DOCUMENTS

| | | | |
|---|---|---|---|
| 5,435,084 | A | 7/1995 | Immel |
| 5,713,145 | A | 2/1998 | Ruvang |
| 5,913,605 | A | 6/1999 | Jusselin |
| 6,848,203 | B2 | 2/2005 | Hohmann |
| 6,959,506 | B2 | 11/2005 | Adamic |
| 6,986,216 | B2 | 1/2006 | Emrich |
| 7,080,470 | B2 | 7/2006 | Jones |
| 7,299,570 | B2 | 11/2007 | Emrich |
| 7,451,558 | B2 | 11/2008 | Jones |
| 7,536,811 | B2 | 5/2009 | McClanahan |
| 7,640,684 | B2 | 1/2010 | Adamic |

(Continued)

FOREIGN PATENT DOCUMENTS

| | | | |
|---|---|---|---|
| AU | 5066602 | A | 8/2002 |
| AU | 2013200095 | A1 | 1/2013 |

(Continued)

OTHER PUBLICATIONS

Office Action mailed Jul. 2, 2025 in related Chinese Application No. 202310382189.4, original and English translation, 20 pages.

(Continued)

*Primary Examiner* — Robert E Pezzuto
(74) *Attorney, Agent, or Firm* — Haynes and Boone, LLP

(57) ABSTRACT

A lock assembly for securing a wear member to a support structure includes a collar and a pin. The collar includes a top surface, a bottom surface opposite the top surface, an outer circumferential profile including at least eight planar surfaces extending around a perimeter of the collar between the top and bottom surfaces, and a bore extending along a central axis from the top surface to the bottom surface. The pin is configured for receipt in the bore of the collar.

18 Claims, 31 Drawing Sheets

(56) References Cited

U.S. PATENT DOCUMENTS

| | | | | |
|---|---|---|---|---|
| 7,762,015 | B2 | 7/2010 | Smith | |
| 7,882,649 | B2 | 2/2011 | Carpenter | |
| 8,074,383 | B2 | 12/2011 | Mcclanahan | |
| 8,117,772 | B2 | 2/2012 | Harder | |
| 8,122,621 | B2 | 2/2012 | Carpenter | |
| 8,122,622 | B2 | 2/2012 | Smith | |
| 8,127,475 | B2 | 3/2012 | Harder | |
| 8,127,476 | B2 | 3/2012 | Bierwith | |
| 8,387,290 | B2 | 3/2013 | Campomanes | |
| 8,393,097 | B2 | 3/2013 | Harder | |
| 8,397,405 | B2 | 3/2013 | Harder | |
| 8,561,326 | B2 | 10/2013 | Ruvang | |
| 8,689,472 | B2 | 4/2014 | Carpenter | |
| 8,839,535 | B2 | 9/2014 | Carpenter | |
| 8,943,718 | B2 | 2/2015 | Ruvang | |
| 9,057,176 | B2 * | 6/2015 | Renski | E02F 9/2833 |
| 9,121,160 | B2 | 9/2015 | Hughes | |
| 9,222,243 | B2 | 12/2015 | Cheyne | |
| 9,493,930 | B2 | 11/2016 | Carpenter | |
| 9,518,379 | B2 | 12/2016 | Kunz | |
| 9,650,764 | B2 | 5/2017 | Carpenter | |
| 9,816,254 | B2 | 11/2017 | Carpenter | |
| 9,920,503 | B2 | 3/2018 | Marchand | |
| 9,963,857 | B2 | 5/2018 | Ruvang | |
| 9,988,795 | B2 | 6/2018 | Hooijmans | |
| 10,030,367 | B2 | 7/2018 | Dare | |
| 10,047,504 | B2 | 8/2018 | Kunz | |
| 10,196,798 | B2 | 2/2019 | Campomanes et al. | |
| 10,364,554 | B2 | 7/2019 | Cheyne | |
| 10,428,494 | B1 | 10/2019 | Lombardo | |
| 10,494,794 | B2 | 12/2019 | Kunz | |
| 10,829,912 | B2 | 11/2020 | Carpenter | |
| 11,072,913 | B2 * | 7/2021 | Cheyne | E02F 9/2858 |
| 11,097,926 | B2 | 8/2021 | Zenier | |
| 11,142,893 | B2 | 10/2021 | Dare | |
| 11,274,422 | B2 | 3/2022 | Wood | |
| 2004/0031175 | A1 | 2/2004 | Hohmann | |
| 2004/0060207 | A1 | 4/2004 | Livesay | |
| 2004/0098886 | A1 | 5/2004 | Hohmann | |
| 2005/0055853 | A1 | 3/2005 | Livesay | |
| 2005/0274047 | A1 | 12/2005 | Pippins | |
| 2007/0245601 | A1 | 10/2007 | Bearden et al. | |
| 2008/0209772 | A1 | 9/2008 | Cui | |
| 2009/0166051 | A1 | 7/2009 | Keech | |
| 2010/0162594 | A1 | 7/2010 | Bierwith | |
| 2014/0215868 | A1 | 8/2014 | Johnston | |
| 2016/0327080 | A1 | 11/2016 | Razzaboni | |
| 2017/0073939 | A1 | 3/2017 | Bjerke | |
| 2017/0075663 | A1 | 3/2017 | Jordan | |
| 2019/0003156 | A1 | 1/2019 | Dare | |
| 2021/0246935 | A1 * | 8/2021 | Grewell | E02F 3/60 |
| 2022/0178116 | A1 | 6/2022 | Wood | |
| 2022/0259830 | A1 | 8/2022 | Hyde | |
| 2022/0333358 | A1 * | 10/2022 | Wood | E02F 9/285 |

FOREIGN PATENT DOCUMENTS

| | | | |
|---|---|---|---|
| CL | 202402985 | A1 | 1/2025 |
| CL | 202403029 | A1 | 7/2025 |
| CN | 103649427 | A | 3/2014 |
| CN | 104105830 | A | 10/2014 |
| CN | 106029996 | A | 10/2016 |
| CN | 107614805 | A | 1/2018 |
| CN | 114174609 | A | 3/2022 |
| EP | 2913446 | A | 9/2015 |
| EP | 3227498 | A1 | 10/2017 |
| EP | 3502361 | A1 | 6/2019 |
| ES | 2358627 | T3 | 12/2011 |
| WO | 2013/009952 | A1 | 1/2013 |
| WO | 2015/089565 | A1 | 6/2015 |
| WO | 2017075663 | A1 | 5/2017 |
| WO | 2020/092844 | A1 | 5/2020 |
| WO | 2021/072488 | A1 | 4/2021 |
| WO | 2022/010729 | A1 | 1/2022 |

OTHER PUBLICATIONS

International Searching Authority, International Search Report and Written Opinion of the International Searching Authority, International Application No. PCT/US23/17772, Jul. 24, 2023, 10 pages, ISA/US.

Search Report mailed Dec. 9, 2025 in related Eurasian patent application No. 202592450, original and English translation, 6 pages.

Search Report mailed Dec. 11, 2025 in related Georgian patent application No. 16801/1, 7 pages.

Examination Report mailed Oct. 10, 2025 in related Australian application No. 2023253573, 9 pages.

Extended European Search Report mailed Mar. 27, 2026 in corresponding application No. 23788781.5, 11 pages.

Office Action mailed Jan. 8, 2026 in related Chinese application No. 202310382189.4, original and translation, 18 pages.

Substantive Examination Report mailed Apr. 20, 2026 for related Chilean patent application No. 202402995, 16 pages.

* cited by examiner

EXCAVATING ASSEMBLY SYSTEM WITH COLLARED FASTENING SYSTEM

PRIORITY

This application claims priority to and the benefit of the filing date of U.S. Provisional Patent Application No. 63/329,807, filed Apr. 11, 2022, titled "Excavating Assembly with Collared Fastening System," which is incorporated herein by reference in its entirety.

TECHNICAL FIELD

This disclosure is generally directed to an excavating assembly including a lock assembly that secures a wear member component to an excavating assembly. More particularly, this disclosure is directed to a wear member system secured using a releasable fastening system having an improved lock assembly with a collar.

BACKGROUND

Material displacement apparatuses, such as excavating buckets found on construction, mining, and other earth moving equipment, often include replaceable wear members such as earth engaging teeth, adapters, wear runners, shrouds, etc. These wear members are often removably carried by larger base structures, such as excavating buckets, or lips secured to excavating buckets, and come into abrasive, wearing contact with the earth or other material being displaced. For example, excavating tooth assemblies provided on digging equipment, such as excavating buckets and the like, typically comprise a relatively massive adapter portion which is suitably anchored to a structure of the equipment such as a forward bucket lip. A replaceable tooth typically includes an opening that releasably receives a nose of an adapter and the tooth is secured to the adapter with a fastening mechanism.

To prevent wearing or damage to the base structure between the tooth assemblies, which are typically spaced apart along the edge of the base structure, shrouds may be secured to the base structure between tooth assemblies. Shrouds may also be positioned along vertical sides or wings at the edges of the base structure.

There are a number of different types of fastening mechanisms to secure shrouds to a bucket lip or other base excavating structure. One method of mounting shrouds to a bucket is to form a series of holes vertically through the forward lip portion of the bucket. Corresponding holes are formed vertically through the shrouds, and, with the shrouds in place on the forward lip portion, the corresponding holes are aligned and wedges are driven therethrough. There are, however, disadvantages of the above-described wedge method of mounting shrouds to an excavating bucket. In the first instance, the wedge method removes material from the forward lip portion by forming a series of holes through the bucket. This may weaken the forward lip portion and provide further surfaces for wear to occur. Further, the need to pound in and later pound out a wedge can give rise to a safety hazard for the installing and removing personnel.

Various alternatives to pound-in fastening mechanisms have been proposed to releasably retain a shroud on an excavating bucket. While these alternative fastening mechanisms desirably eliminate the need to pound a wedge into and out of a bucket lip, they typically present various other types of problems, limitations, and disadvantages including, but not limited to, complexity of construction and use or undesirably high cost. In one example, in U.S. Pat. No. 5,713,145 to Ruvang, a shroud having a generally C-shaped cross section is removably attached to the front edge of an excavating bucket lip by first placing the front lip edge in the interior of the wear shroud so that the top and bottom legs of the shroud respectively extend along the top and bottom sides of the lip. A rear end portion of the top shroud leg is then removably secured, using a J-bolt inserted into the top leg after the shroud is positioned on the bucket lip, to a base structure welded to the top side of the lip. A nut threaded onto the J-bolt at the rear end of the top shroud leg and facing the welded base structure prevents the forward removal of the installed wear shroud from the bucket lip. While this particular system has proven to be well suited for its intended purpose, it has several limitations and disadvantages. For example, the system requires that a portion of each shroud have a relatively high frontal projection area which increases the resistance to penetration of the shroud into the material being excavated. Additionally, portions of the fastening mechanism exposed to material being excavated may be subject to undesirable abrasion wear.

Some types of fastening mechanisms include a component rotatable between a locked position and an unlocked position. However, the continuous vibration, high impact, and cyclic loading of the shroud can result in inadvertent rotation of the fastening mechanism from a locked position to an unlocked position. This may cause excess wear on the fastening mechanism and/or inadvertent release of the shroud or affect the useful life of both the fastening mechanism and the shroud.

A need accordingly exists for an improved shroud assembly fastening mechanism.

SUMMARY

Consistent with some examples, a lock assembly for securing a wear member to a support structure may include a collar and a pin. The collar may have a top surface, a bottom surface opposite the top surface, an outer circumferential profile including at least eight planar surfaces extending around a perimeter of the collar between the top and bottom surfaces, and a bore extending along a central axis from the top surface to the bottom surface. The pin may be configured for receipt in the bore of the collar.

Consistent with some examples, a lock assembly for securing a wear member to a support structure may include a collar and a pin. The collar may have a top surface, a bottom surface opposite the top surface, and a bore extending along a central axis from the top surface to the bottom surface. The collar may have an irregular outer circumferential profile about the central axis that is asymmetrical about any plane parallel to the central axis. The pin may be configured for receipt in the bore of the collar.

Consistent with some examples, a lock assembly for securing a wear member to a support structure may include a collar and a pin. The collar may have a top surface, a bottom surface opposite the top surface, and a bore extending along a central axis from the top surface to the bottom surface. The collar may have an irregular outer circumferential profile about the central axis. A rear surface extending between the top surface and the bottom surface may be angled with respect to the central axis. The pin may be configured for receipt in the bore of the collar.

In some examples, at least a portion of a wall defining the bore of the collar may include first threads and at least a portion of an outer surface of the pin may include second threads corresponding to the first threads. The collar further may include a biased pin detent mechanism. A portion of the pin detent mechanism may extend into the bore. The pin may have an indentation adjacent to an upper end of the second threads that is configured to receive the portion of the pin detent mechanism when the pin is fully seated in the collar. The pin detent mechanism may include a flexible member and a rigid member secured to the flexible member. The collar may include a recess extending radially outward from the bore and axially inward from the top surface. The recess may be at least partially wedge-shaped with a narrower width at a front side adjacent to the bore and a greater width at a rear side opposite the bore. The flexible member of the pin detent mechanism may have a shape corresponding to the recess. The portion of the pin detent mechanism may be configured to pass through a channel formed in the second threads of the pin as the pin is rotated with respect to the collar. A top surface of the pin may be substantially flush with or recessed below the top surface of the collar when the pin is fully seated in the collar. In some examples, a collar may include a first biased detent mechanism extending outward from a first lateral side of the collar and a second biased detent mechanism extending outward from a second lateral side of the collar. The first biased detent mechanism may be disposed adjacent a first end of the collar and the second biased detent mechanism may be disposed adjacent a second end of the collar.

In some examples, a first biased detent mechanism may extend outward from a first front corner surface of the collar and a second biased detent mechanism may extend outward from a second front corner surface of the collar. A third biased detent mechanism may extend outward from a rear surface of the collar.

In some examples, the outer circumferential profile of the collar may be defined at least in part by a front surface, a rear surface, opposing side surfaces, and four corner surfaces. The outer circumferential profile of the collar may be laterally symmetrical about a plane extending from a front side of the collar to a rear side of the collar and extending between the top and bottom surfaces.

In some examples, the irregular outer circumferential profile of the collar may include a plurality of minor arcs each having a radius of curvature different than each other minor arc of the plurality of minor arcs. The irregular outer circumferential profile of the collar may be defined by a plurality of curved surfaces extending between adjacent sides of the collar. The irregular outer circumferential profile of the collar may be asymmetric about any plane parallel to the central axis. In some examples, the irregular outer circumferential profile of the collar may be defined by a plurality of minor arcs each having a radius of curvature different than each other minor arc of the plurality of minor arcs.

In some examples, a rear surface extending between the top surface and the bottom surface and defining a rear side of the collar may be angled with respect to the central axis of the bore. The rear surface of the collar may be angled away from the central axis toward the bottom surface of the collar at approximately 1-20° with respect to the central axis of the bore, for example, at approximately 2-12°. A front side of the collar and a rear side of the collar may be tapered toward the central axis of the bore in a direction extending from the bottom surface to the top surface.

In some examples, a head of the pin may include a post having a hexagonal outer profile. A hexagonal recess may be formed into the post. The pin may include a shaft that narrows toward a tip of the pin disposed opposite a head of the pin. The shaft may have an outer surface that is angled at approximately 1-10° with respect to a central axis of the pin, for example, at approximately 2-4°. In some examples, the shaft may by cylindrical. In some examples, an upper portion of the shaft may be cylindrical and a lower portion of the shaft may narrow toward the tip. In some examples, an upper portion of the shaft may be angled with respect to a central axis of the pin at a first angle and a lower portion of the shaft may be angled with respect to the central axis of the pin at a second angle that is greater than the first angle.

Consistent with some examples, a wear member assembly for excavating equipment includes a wear member and a collar. The wear member may include an upper leg extending rearward away from a leading edge of the wear member to a rear surface. The leading edge may be configured to engage ground. A passage may extend along a first central axis through the upper leg from a top surface. A support structure recess may be formed into a lower side of the upper leg and extend rearward through the rear surface of the upper leg. The support structure recess may be configured to receive a support structure when the wear member is secured to excavating equipment. A lock recess may extend upward from a ceiling of the support structure recess to the passage. The collar may be configured for receipt within the lock recess of the wear member from the lower side of the upper leg. The collar may have a bore extending from a top surface of the collar to a bottom surface of the collar. The bore may be coaxial with the passage of the wear member when the collar is seated within the lock recess.

In some examples, a portion of the support structure recess may extend above the bottom surface of the collar. For example, lateral side portions of the support structure recess configured to receive wings of a support structure may extend upward above a bottom surface of the lock recess.

In some examples, the wear member may have at least one pocket formed into a wall of the lock recess and the collar may have at least one biased detent mechanism extending outward away from the bore. The at least one detent mechanism may be configured to be at least partially disposed within the at least one pocket when the collar is seated within the lock recess. The at least one detent mechanism may be configured to retain the collar within the lock recess. The at least one detent mechanism may include a first detent mechanism and a second detent mechanism extending from an opposing side of the collar from the first detent mechanism. The first detent mechanism may be disposed adjacent a first end of the collar and the second detent mechanism may be disposed adjacent a second end of the collar. The at least one pocket may include a first pocket and a second pocket disposed on opposing walls of the lock recess. The opposing walls of the lock recess may be tapered inward with respect to the first central axis toward the top surface of the wear member such that the opposing walls of the lock recess are spaced apart by a first distance in an upper region of the lock recess and by a second distance greater than the first distance in a lower region of the lock recess. The first distance may be less than a corresponding width of the collar from an outward facing surface of the first detent mechanism to an outward facing surface of the second detent mechanism such that, as the collar is inserted into the lock recess, the opposing walls increasingly compress a flexible member of each of the first and second detent mechanisms until the first and second detent mechanisms are aligned with a respective one of the first and second pockets.

In some examples, an outer circumferential profile of the collar may be defined by a plurality of curved surfaces extending between adjacent sides of the collar. The collar may have an irregular outer circumferential profile including a plurality of minor arcs each having a radius of curvature different than each other minor arc of the plurality of minor arcs. The irregular outer circumferential profile of the collar may be asymmetric about any plane parallel to a central axis of the bore. The lock recess may have an irregular circumferential profile corresponding to the irregular outer circumferential profile of the collar. The collar and lock recess may be sized and shaped such that the collar is installable into the lock recess in only one orientation. The collar may have a protrusion jutting forward along a front side of the collar. When the collar is seated within the lock recess, the bottom surface of the collar may be above ceiling of the support structure recess.

In some, examples, a central region of the upper leg may have an increased vertical profile relative to portions of the upper leg on each lateral side of the central region. The increased vertical profile may accommodate a height of the collar between the top and bottom surfaces of the collar to receive the collar in the lock recess with the bottom surface of the collar flush with or disposed above the ceiling of the support structure recess. A rear surface of the collar extending between the top and bottom surfaces of the collar and defining a rear side of the collar may be angled with respect to the central axis of the bore. The rear surface of the collar may be angled away from the central axis of the bore in a direction extending from the top surface of the collar to the bottom surface of the collar at approximately 1-20° with respect to the central axis of the bore, for example, at approximately 2-12°. A front side of the collar and a rear side of the collar may be tapered toward the central axis of the bore in a direction extending from the bottom surface of the collar to the top surface of the collar.

In some examples, the wear member may be a shroud and may further include a lower leg extending rearward away from the leading edge. The shroud may have a transverse channel formed between the upper leg and the lower leg. The transverse channel may be configured to receive a lip of the excavating equipment. The shroud may have a contact pad formed in the transverse channel. The contact pad may be configured to engage a front surface of the lip. A portion of the lower leg configured to lie adjacent a bottom surface of the lip may be angled at approximately 10-20° with respect to a portion of the upper leg configured to engage an upper surface of the lip, for example, at approximately 15°. In some examples, the portion of the upper leg may be parallel to the portion of the lower leg.

In some examples, the support structure recess may extend between two opposing slots extending forward from the rear surface and may be configured to receive opposing wings of a fixation base secured to the lip.

Consistent with some examples a wear member for excavating equipment may include a leading edge, an upper leg extending rearward away from the leading edge, a passage extending through the upper leg from a top surface of the wear member, and a fixation base recess formed into a lower side of the upper leg and extending rearward through a rear surface of the upper leg. The fixation base recess may extend laterally between two opposing slots that extend forward from the rear surface of the upper leg. Each of the two slots may be angled inward toward one another from the rear surface and may have a lower surface angled downward toward each other. The fixation base recess may be configured to receive a fixation base secured to a lip of excavating equipment. A portion of a bottom surface of the upper leg below each of the two slots may form a planar contact surface configured to engage the lip. In some examples, the portions of the bottom surface of the upper leg forming a planar contact surface may extend along a majority of the length of the upper leg.

In some examples, a pry surface may extend between the rear surface of the upper leg and a ceiling of the fixation base recess. At least one pry surface may extend between the top surface of the wear member and a surface defining the passage.

In some examples, a lock recess may extend upward from a ceiling of the fixation base recess to the passage. At least one pocket may be formed into a wall of the lock recess. Opposing walls of the lock recess may be tapered inward with respect to a central axis of the passage toward the top surface of the wear member. A circumferential profile of the lock recess may be defined in part by a plurality of curved surfaces. The lock recess may have an irregular circumferential profile including a plurality of minor arcs each having a radius of curvature different than each other minor arc of the plurality of minor arcs. The irregular circumferential profile of the lock recess may be asymmetric about any plane parallel to a central axis of the passage. The lock recess may have a notch extending forward away from a central axis of the passage. A rear wall of the lock recess may be angled with respect to a central axis of the passage. The rear wall may be angled at approximately 1-20° with respect to the central axis of the passage, for example, at approximately 2-12°. A front wall of the lock recess and a rear wall of the lock recess may be tapered toward a central axis of the passage.

In some examples, a wear member may include a lower leg that extends rearward away from the leading edge. The wear member may include a transverse channel formed between the upper leg and the lower leg. The transverse channel may be configured to receive the lip. A contact pad may be formed in the transverse channel. The contact pad may be configured to engage a front surface of the lip.

In some examples, a central region of the upper leg may have an increased vertical profile relative to portions of the upper leg on each lateral side of the central region. A raised region may be formed in the top surface of the upper leg in the central region. The passage may extend through the raised region. Each of the two slots may extend forward beyond a front wall of the lock recess.

Consistent with some examples, a fixation base has a bottom surface, a top surface, a central opening, and opposing first and second wings. The central opening may extend through the top surface and the bottom surface. The central opening may be bounded at a front side by a lock wall configured to engage a portion of a lock. Each of the first and second wings may extend upward and laterally outward away from the central opening. The first and second wings may be angled apart toward a rear side of the fixation base and may have a lower surface angled downward toward the central opening.

In some examples, a rear opening extends through the top surface and the bottom surface in an extension extending from a rear side of the fixation base. The rear opening may be separated from the central opening by a lateral wall. A rear wall of the extension may include a pry surface extending between a top surface of the rear wall and a front surface of the rear wall. The lateral wall may include a pry surface extending between a top surface of the lateral wall and a front surface of the lateral wall.

Consistent with some examples, a wear member assembly may include a fixation base, a wear member, and a lock assembly. The fixation base may be disposed on a lip and positioned behind a leading edge of the lip. The fixation base may have a bottom surface, a top surface, a central opening extending through the top surface and the bottom surface, and opposing first and second wings. The central opening may be bounded at a front side by a lock wall. The opposing first and second wings may extend upward and laterally outward away from the central opening. The first and second wings may be angled apart toward a rear side of the fixation base and may have a lower surface angled downward toward the central opening. The wear member may have a leading edge, an upper leg extending rearward away from the leading edge, a passage extending through the upper leg from a top surface of the wear member, a lock recess extending upward from a bottom side of the upper leg to the passage, and a fixation base recess formed into a lower side of the upper leg and extending rearward through a rear surface of the upper leg. The fixation base recess may extend laterally between two opposing slots that extend forward from the rear surface of the upper leg. At least a portion of the first and second wings of the fixation base may be positionable within the two opposing slots. The lock assembly may include a collar and a pin. The collar may be positioned within the lock recess of the wear member. The collar may have a top surface, a bottom surface opposite the top surface, and a bore extending along a central axis from the top surface to the bottom surface. The pin may be positionable within the bore of the collar and configured to extend from the collar into the fixation base to engage the lock wall of the fixation base.

It is to be understood that both the foregoing general description and the following drawings and detailed description are exemplary and explanatory in nature and are intended to provide an understanding of the present disclosure without limiting the scope of the present disclosure. In that regard, additional aspects, features, and advantages of the present disclosure will be apparent to one skilled in the art from the following detailed description and the drawings.

BRIEF DESCRIPTION OF THE DRAWINGS

The accompanying drawings illustrate implementations of the systems, devices, and methods disclosed herein and together with the description, serve to explain the principles of the present disclosure.

Figure 1:
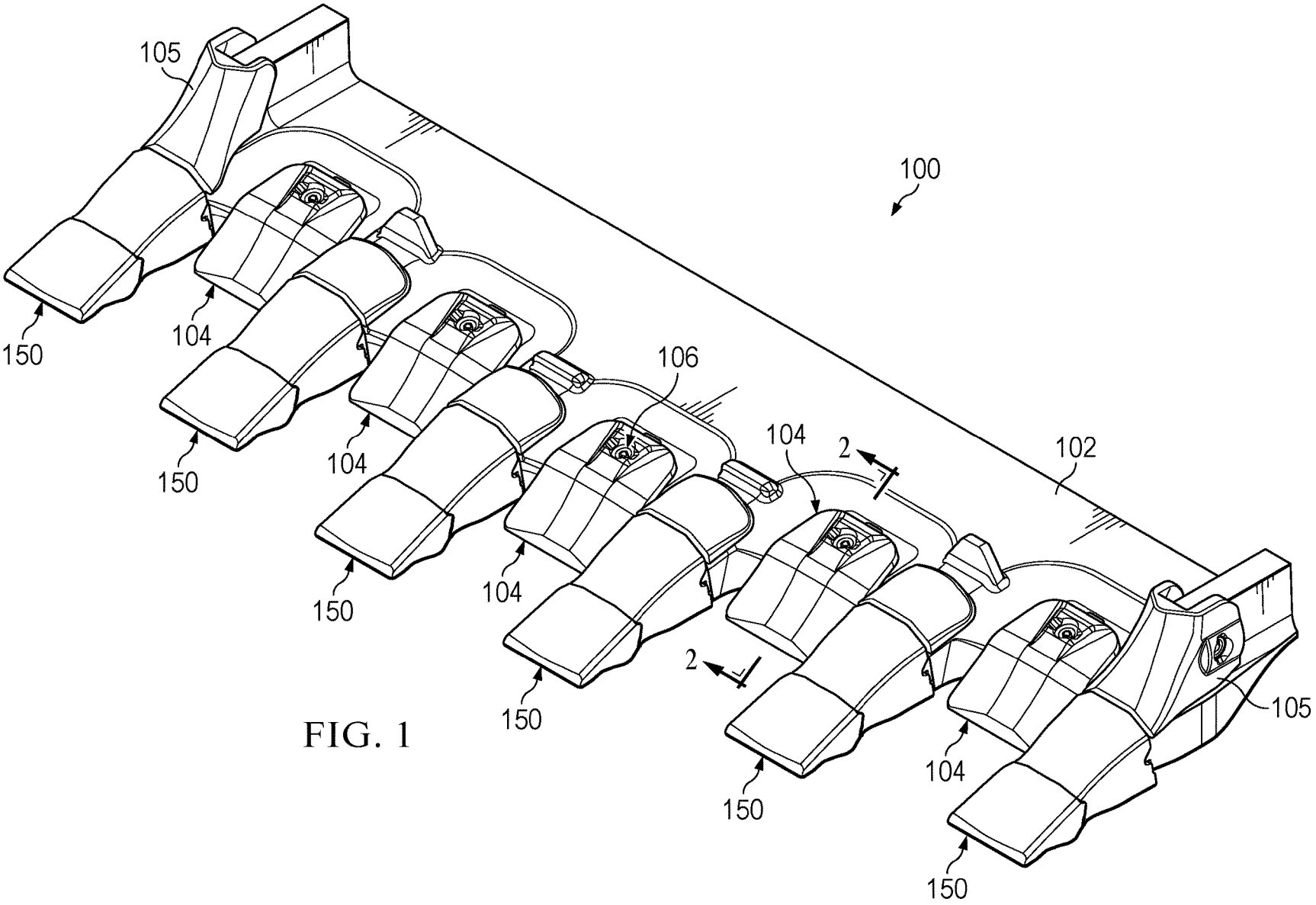
FIG. 1 is a perspective view of an excavation system embodying principles of the present disclosure.

These Figures will be better understood by reference to the following Detailed Description.

DETAILED DESCRIPTION

For the purpose of promoting an understanding of the principles of the present disclosure, reference will now be made to the implementations illustrated in the drawings and specific language will be used to describe them. It will nevertheless be understood that no limitation of the scope of the disclosure is intended. Any alterations and further modifications to the described devices, instruments, methods, and any further application of the principles of the present disclosure are fully contemplated as would normally occur to one skilled in the art to which the disclosure relates. In addition, this disclosure describes some elements or features in detail with respect to one or more implementations or Figures, when those same elements or features appear in subsequent Figures, without such a high level of detail. It is fully contemplated that the features, components, and/or steps described with respect to one or more implementations or Figures may be combined with the features, components, and/or steps described with respect to other implementations or Figures of the present disclosure. For simplicity, in some instances the same or similar reference numbers are used throughout the drawings to refer to the same or like parts.

The present disclosure is directed to an excavating assembly that may include a fastening system that secures a wear member component within the excavating assembly. More particularly, this disclosure is directed to a wear assembly, such as a lip shroud assembly, that may include a wear member secured to a fixation base using a releasable fastening system having a lock assembly that includes a collar, a pin positionable within the collar, and detent mechanisms for securing the collar and the pin. The collar may be positionable within a portion of the wear member and secured thereto with snap-in detent mechanisms. The pin may be advanced into the collar and secured therein by threads and a snap-in detent mechanism which may provide haptic feedback to a user and/or prevent inadvertent loosening or removal of the pin. When so positioned, a portion of the pin may extend into a fixation base secured to a bucket lip or other excavating structure such that the pin interferes with removal of the wear member from the fixation base on the bucket lip. It should be appreciated that although described in the context of a wear member comprising a shroud and a support structure comprising a fixation base, the present disclosure may also be applicable for securing other wear members to support structures, for example, a tooth to an adapter, an intermediate adapter to an adapter, or a wear plate, such as a wear runner to an excavating structure.

Since the lock assembly employs mechanical interference to prevent inadvertent rotation of the pin, the lock assembly may be able to withstand vibration, high-impact, and cyclic loading while minimizing the chance of becoming inadvertently unlocked. In addition, some embodiments of the lock assembly may be arranged to emit an audible noise such as a click when various components achieve a locked or secured condition. Because of this, users such as machinery operators may have an easier time installing new shrouds and replacing old shrouds as compared to conventional fastening mechanisms.

FIG. 1 shows an example of an excavation system 100 according to the present disclosure, including a bucket lip 102 which may be an integral part of a bucket or a separate component that may be secured to a bucket by welding or fasteners. The excavation system 100 also includes tooth assemblies 150 at spaced apart positions along a forward edge of the bucket lip 102. Between the tooth assemblies 150 are shrouds 104 secured to the bucket lip 102 using lock assemblies 106. At each side of the bucket lip is a vertically extending wing with a side shroud 105. The side shrouds may be secured to the bucket lip 102 using the same or similar lock assembly 106. The excavation system 100 may find particular utility on earth moving equipment. For example, the excavation system 100 may be used in construction, mining, drilling, and other industries.

Figure 2:
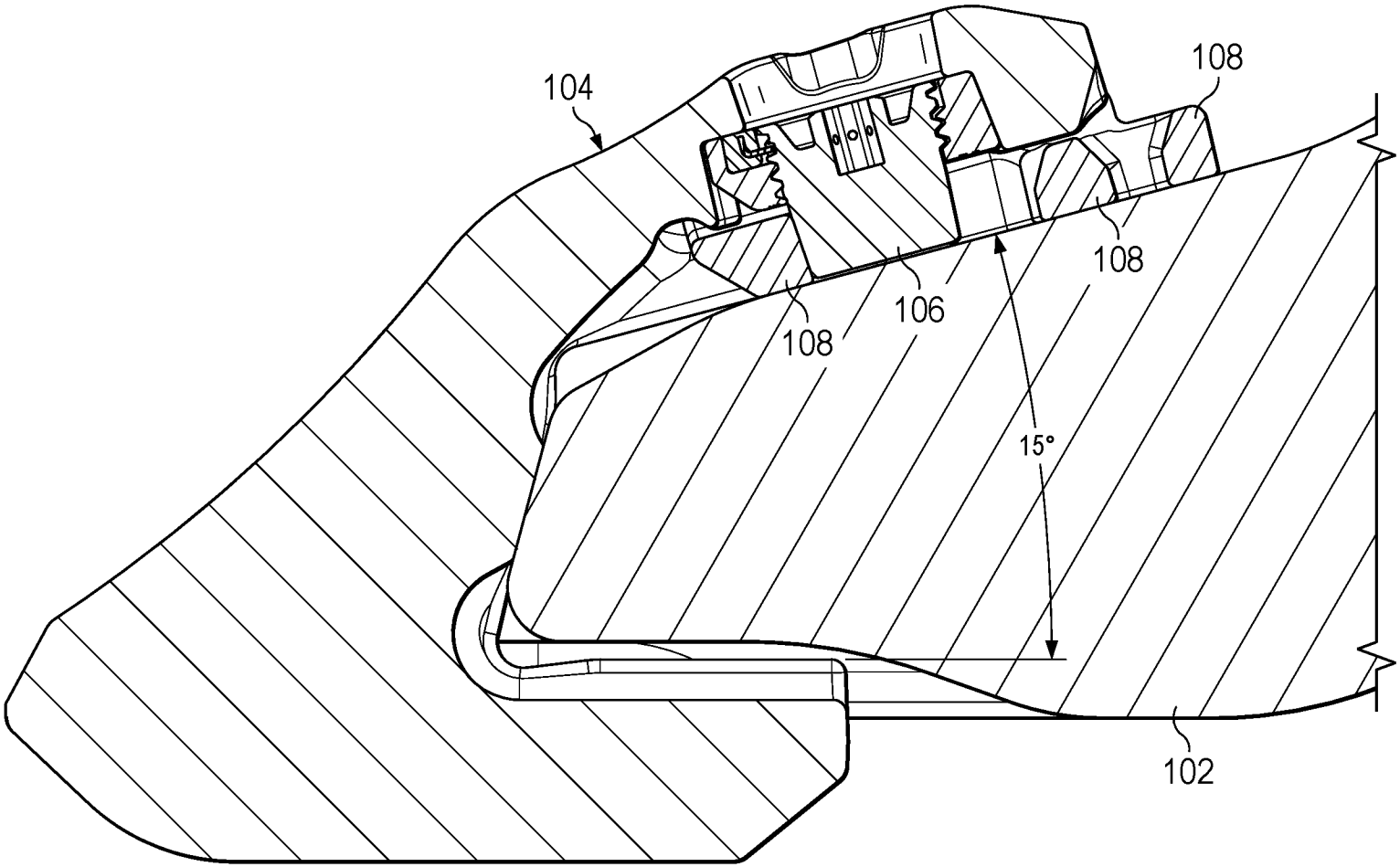
FIG. 2 is a cross-section through a lip shroud assembly of the excavation system of FIG. 1.

FIG. 2 shows a cross-section through the excavation system 100 of FIG. 1, specifically through one of the shrouds 104. In this example, a fixation base 108 is secured to the bucket lip 102. A lock assembly 106 is positioned such that it is positioned partially within the shroud 104 and partially within the fixation base 108 to retain the shroud 104 on the bucket lip 102. It should be appreciated that although described in relation to a shroud secured to a bucket lip, assemblies according to the present disclosure may include any type of wear member and corresponding support structure to which a wear member is affixed with a lock assembly. The shroud may be configured to engage or lie adjacent to a bottom surface of the bucket lip and to engage a top surface of the bucket lip. An angle between the bottom and top surfaces of the bucket lip may be approximately 5-30°, for example, approximately 15° in the illustrated example. In some examples, the top and bottom surfaces of the bucket lip may be parallel. Portions of the shroud 104 configured to engage or lie parallel to the bottom and top surfaces of the bucket lip may be planar and may have an orientation within 0-4° of the corresponding top or bottom surface of the bucket lip.

Figure 3:
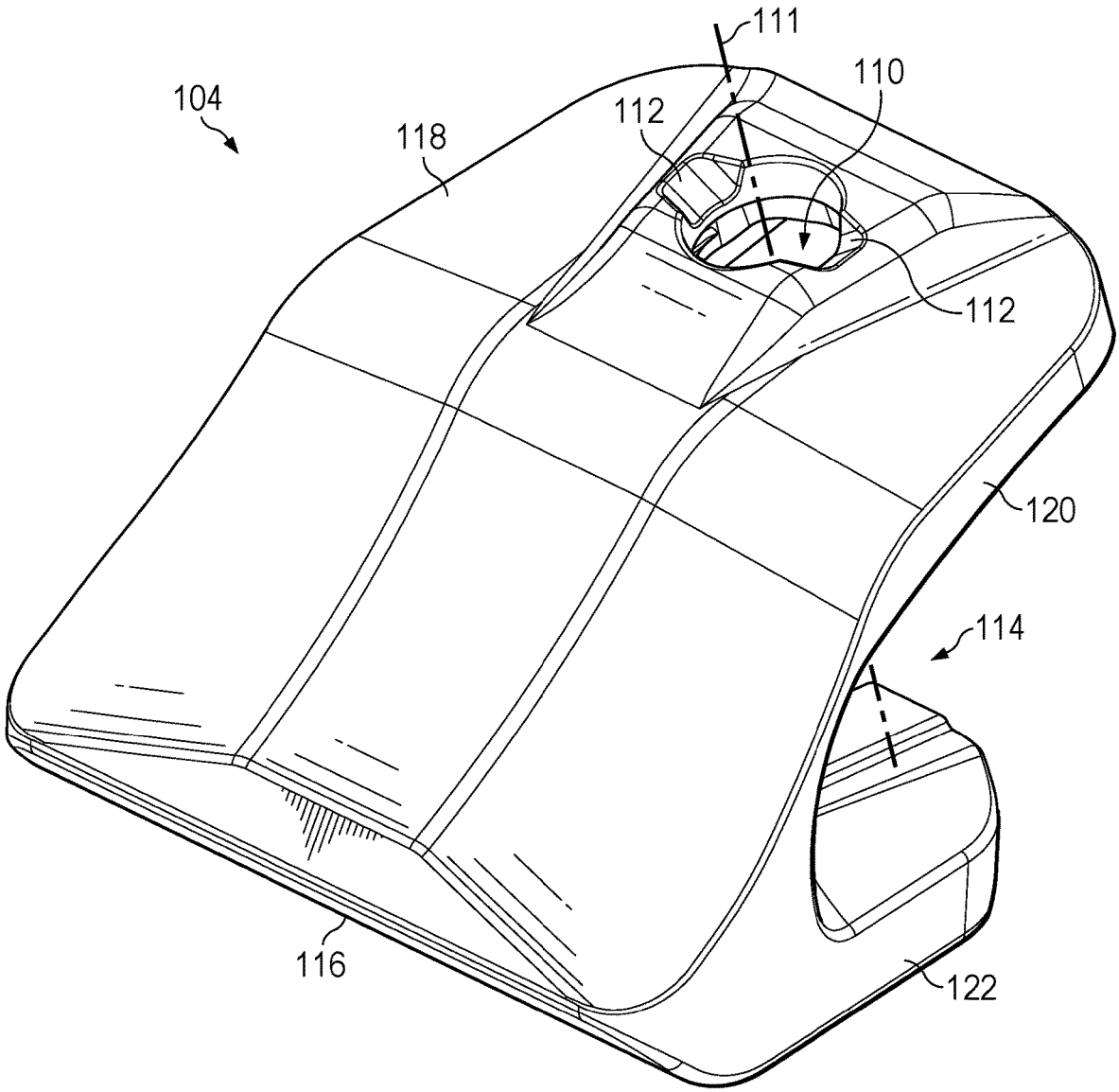
FIG. 3 is a perspective view of an example of a shroud according to the present disclosure.

FIG. 3 illustrates an example of a shroud 104. The shroud 104 has a channel 114 extending from a rear side of the shroud and a leading edge 116 across a front side. The channel 114, which is formed between an upper leg 120 and a lower leg 122 of the shroud 104, is configured to receive a forward edge of a bucket lip. In some examples, the shroud may include only one leg, such as only an upper leg 120 without a corresponding lower leg 122 or vice versa. When installed, the shroud 104 straddles the forward edge of the bucket lip with the upper leg 120 on a top side of the bucket lip and the lower leg 122 on the bottom side of the bucket lip, as shown in FIG. 2. A passage 110 extends through the top leg 120 from a top surface 118 of the shroud to the channel 114 along a central axis 111. The passage 110 is configured to receive a pin of a lock assembly 106. On opposing lateral sides of the passage 110, pry surfaces 112 are formed into the top surface 118. The pry surfaces 112 extend at an angle between the top surface 118 and a substantially vertical wall forming the passage 110. The pry surfaces 112 are configured to permit a pry bar or other tool to be inserted into the passage 110 to engage the pin for removal. In the illustrated embodiment, the top surface 118 includes a raised region in which the passage 110 is disposed. The raised region includes sloping side surfaces extending from the passage 110 to the side regions of the upper leg 120 forming the top surface 118. A portion of these sloping side surfaces may form a ridge where they intersect the pry surfaces, providing a fulcrum for lifting the pin from the passage 110 with a tool. Although illustrated with two pry surfaces 112, one on each lateral side of the passage 110, it should be appreciated that fewer or more pry surfaces 112 may be formed around the passage 110. Further, a pry surface 112 may be positioned at any radial location around the circumference of the passage 110, for example, rearward or forward of the passage 110.

Figure 4:
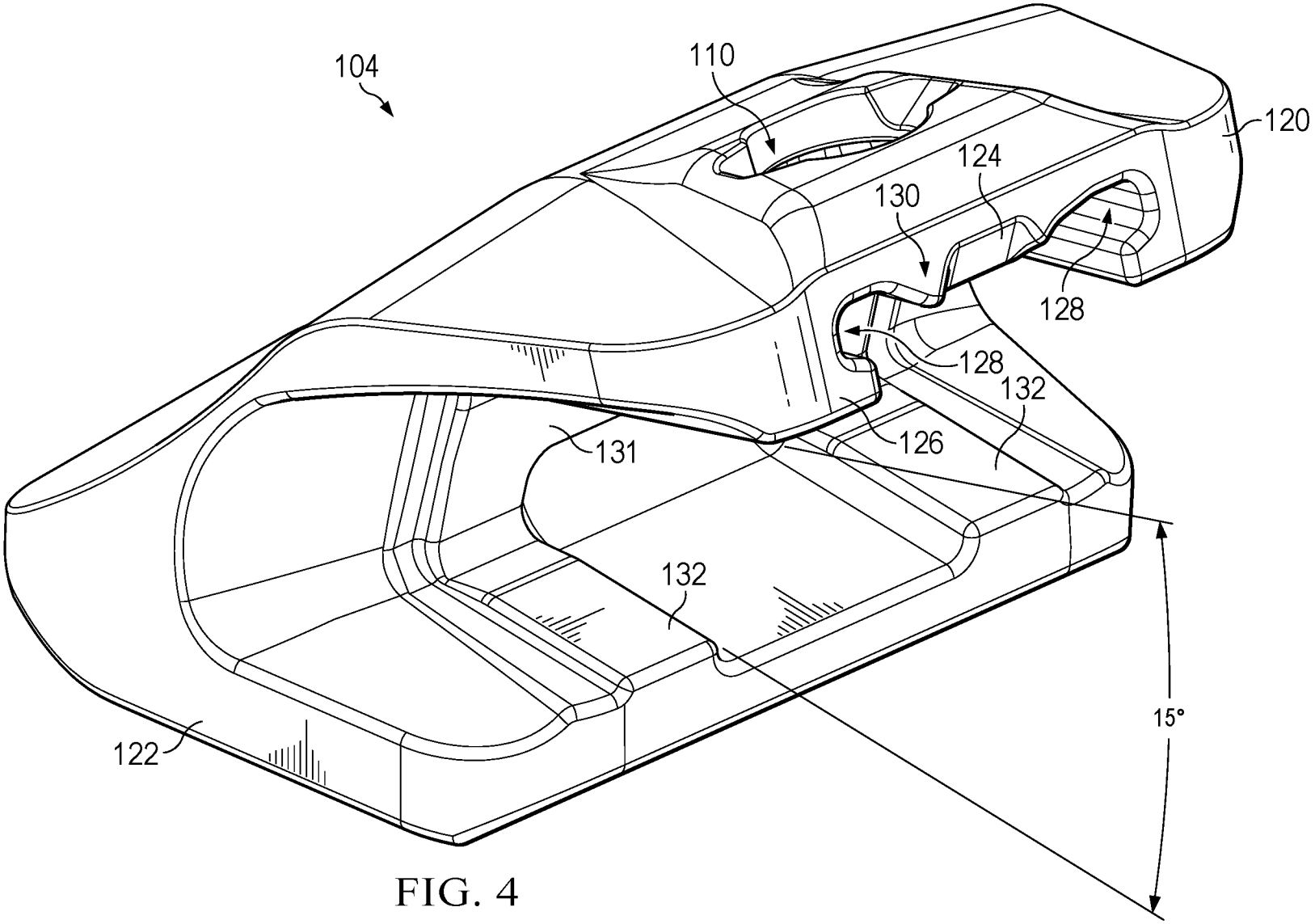
FIG. 4 is a perspective view of the shroud of FIG. 3.
Figure 5:
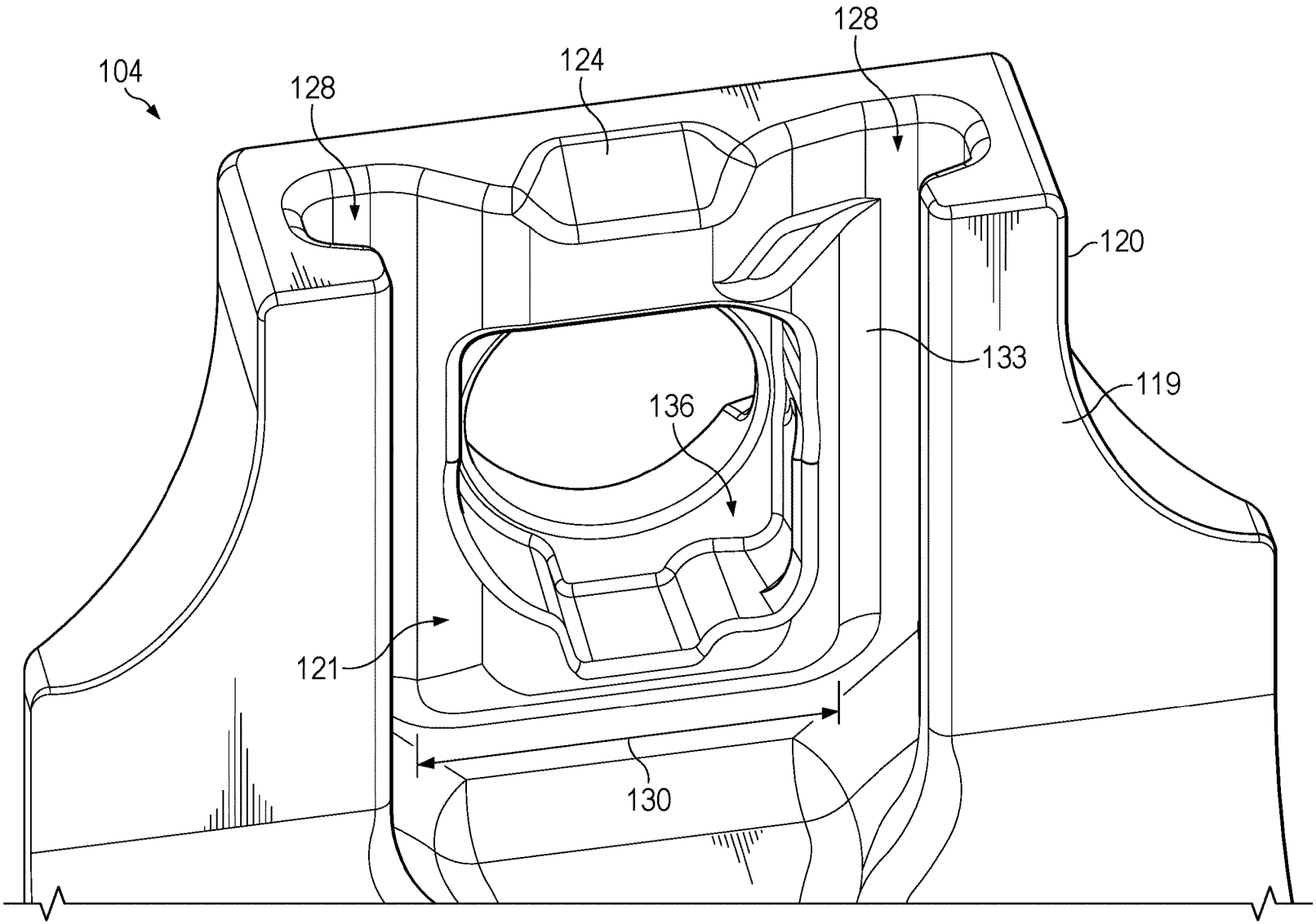
FIG. 5 is a rear perspective view of a portion of the shroud of FIG. 3.
Figure 6:
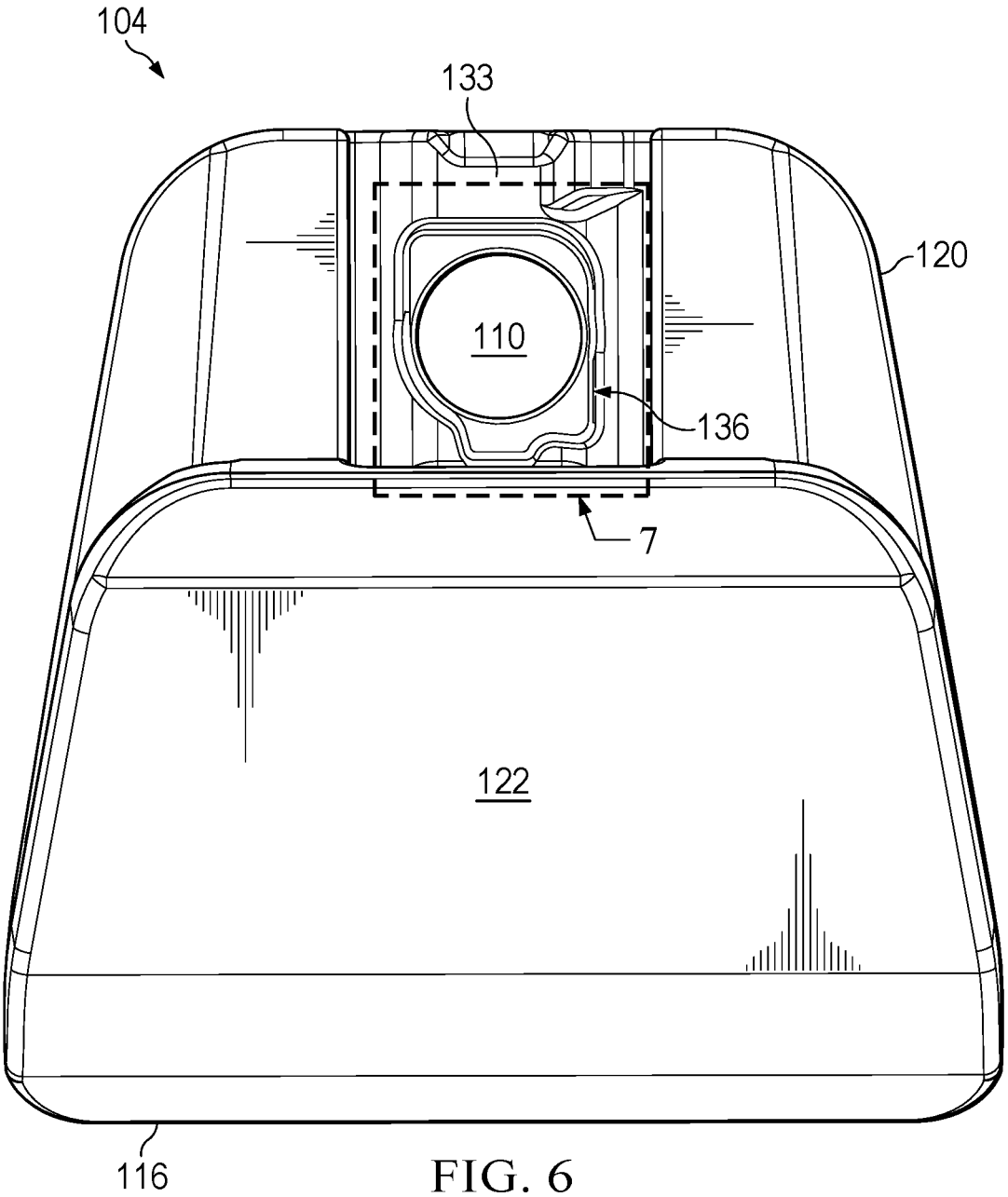
FIG. 6 is a bottom view of the shroud of FIG. 3.

FIGS. 4-6 illustrate the shroud of FIG. 3 from a rear and bottom perspectives. A bottom surface 119 of the upper leg 120 is disposed opposite the top surface 118, although not necessarily parallel to the top surface 118. The upper leg 120 terminates rearwardly at a rear surface 126 extending across the upper leg. A fixation base recess 121 is formed into the upper leg 120 extending upward from the bottom surface 119 to a ceiling 133 and forward from the rear surface 126. A pry surface 124 is formed at an angle between the rear surface 126 and ceiling 133 of the fixation base recess 121. The pry surface may be configured to permit a pry bar or other tool to be inserted into the fixation base recess 121 to engage a fixation base for removal of the shroud 104. A slot 128 is formed on either side of the fixation base recess 128 and is configured to receive a corresponding wing portion of a fixation base. Each of these two slots extends forward from the rear surface 126 in a direction perpendicular to the rear surface or angling slightly toward one another along their longitudinal length for ease of installation and removal from a fixation base. For example, the slots may be angled inward at 1-5° with respect to plane of symmetry between them, preferably at approximately 2°. Surfaces forming the top and bottom of each slot 128 may be parallel to the bottom surface 119 of the upper leg 120 or may angle upward with respect to the bottom surface 119 as the slots 128 extend laterally outward. In other words, a lower surface of each slot may be angled toward the other slot at approximately 10-30°, preferably at 20°, with respect to a horizontal plane. An upper surface of each slot may be angled in a similar manner. The upper and lower surfaces of each slot may be parallel or oriented at different angles.

A central region 130 of the ceiling 133 of the fixation base recess 121 extends downward toward the channel 114 in a similar manner to the raised region of the top surface on the opposite side of the upper leg 120. Within the central region 130 is a lock recess 136 that is configured to receive a collar of a lock assembly. The lock recess 136 is aligned with the passage 110 such that the passage 110 extends into the lock recess from the top surface 118.

Within the channel 114 are two ribs 132 extending along a top side of the lower leg 122. The ribs 132 have a substantially planar top surface configured to engage or lie adjacent to a bottom surface of a bucket lip when the shroud 104 is installed. Each rib extends upward on a front wall of the channel and intersects a contact pad 131 that extends between the two ribs 132. The contact pad 131 forms an engagement region where the shroud 104 contacts and bears against a front surface of a bucket lip during use. One or more portions of the lower leg 122 adjacent a bottom surface of the bucket lip, for example a top surface of each rib 132, may be parallel to or may be angled with respect to one or more portions of the upper leg 120 configured to contact a top surface of the bucket lip, for example a planar region disposed below a respective one of the two slots 128. In the illustrated example, the top surface of the ribs 132 is angled at approximately 15° with respect to the bottom surface of the upper leg 120. It should be appreciated that in some examples, one or more of the contact pad 131 and/or the ribs 132 may be omitted.

Figure 7:
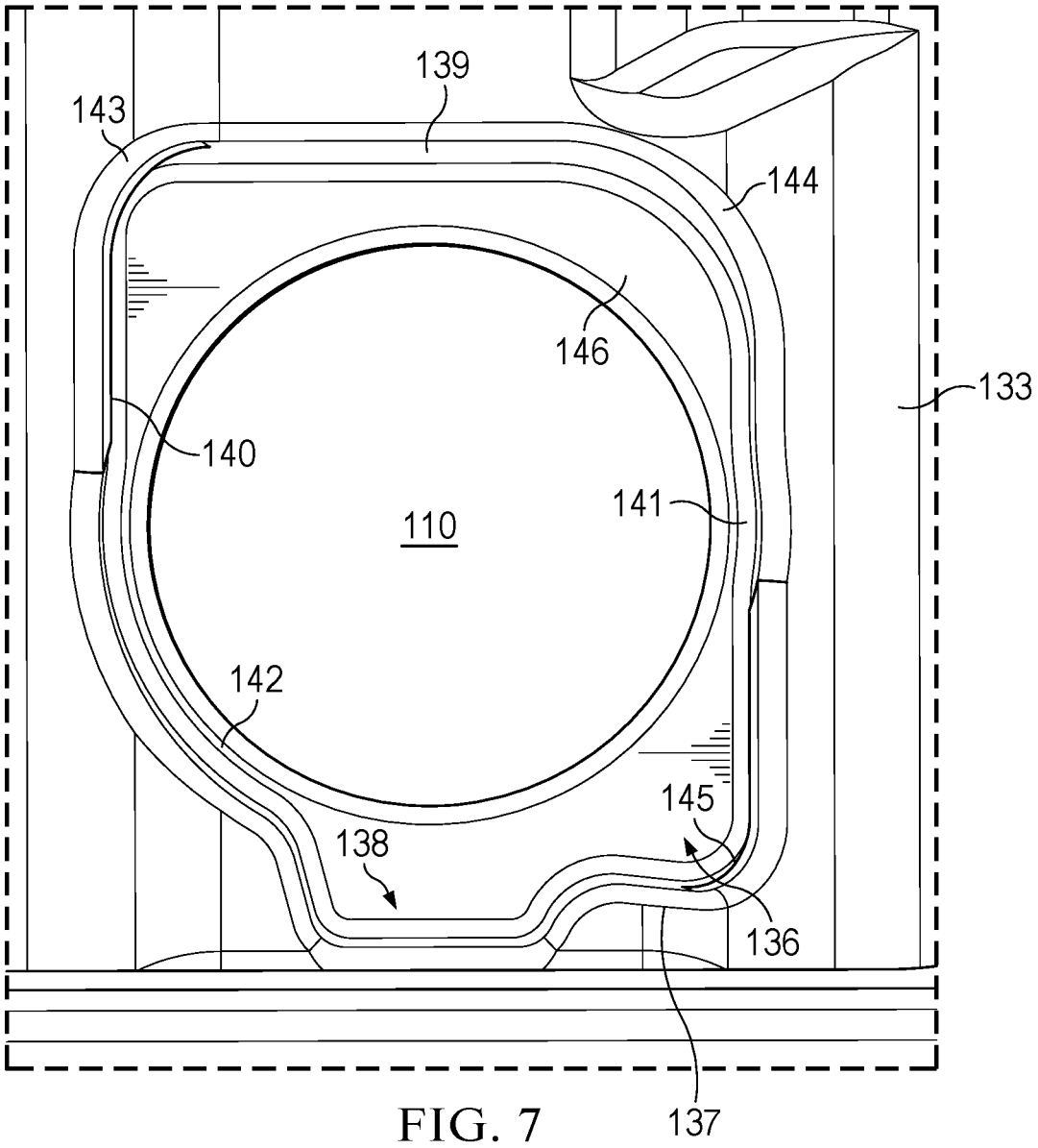
FIG. 7 is an enlarged view of an example of a lock recess according to the present disclosure.
Figure 8:
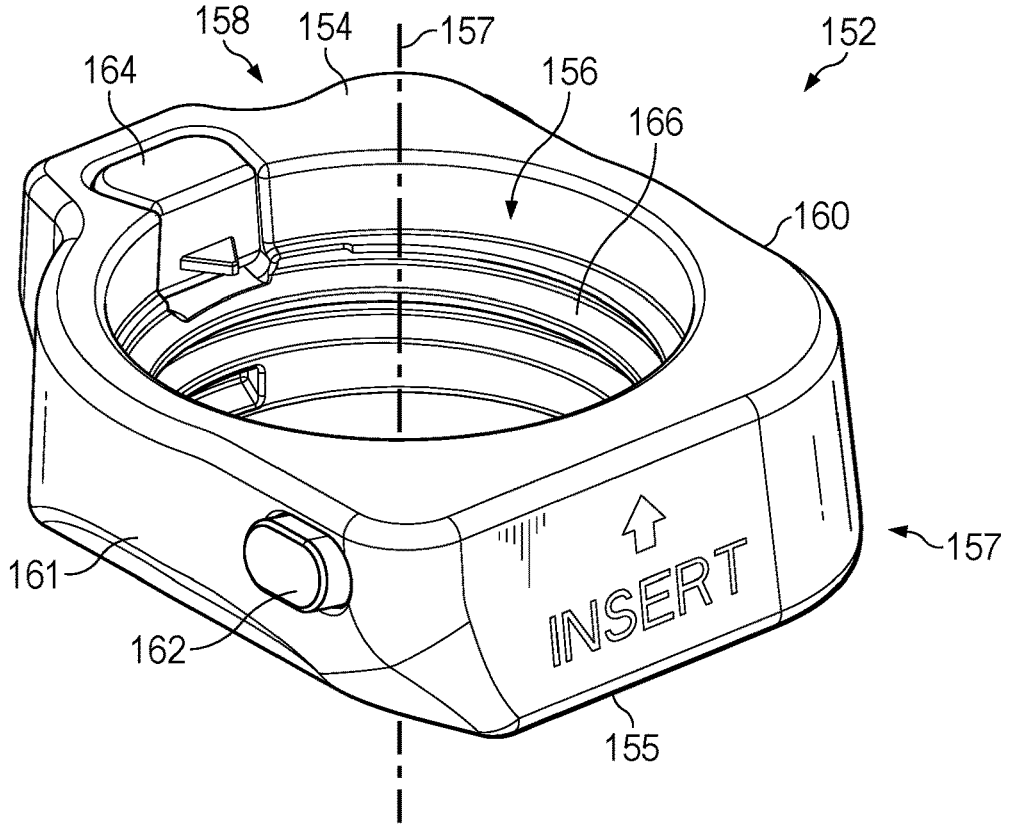
FIG. 8 is a perspective view of a top side of an example of a collar according to the present disclosure.
Figure 9:
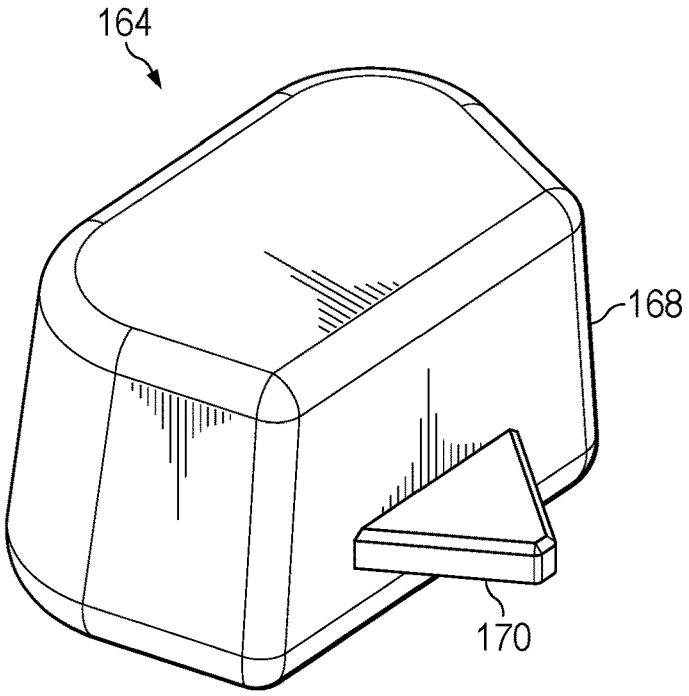
FIG. 9 is a perspective view of an example of a pin detent according to the present disclosure.
Figure 10:
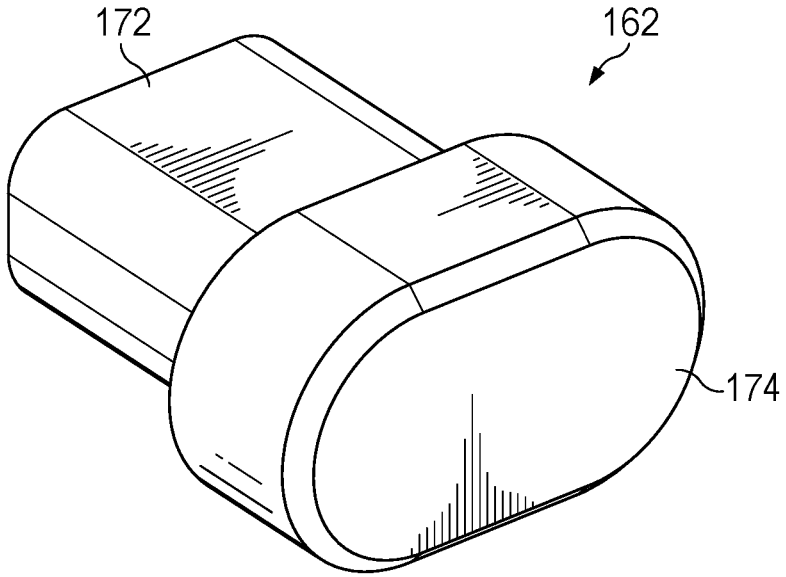
FIG. 10 is a perspective view of an example of an installation detent according to the present disclosure.
Figure 11:
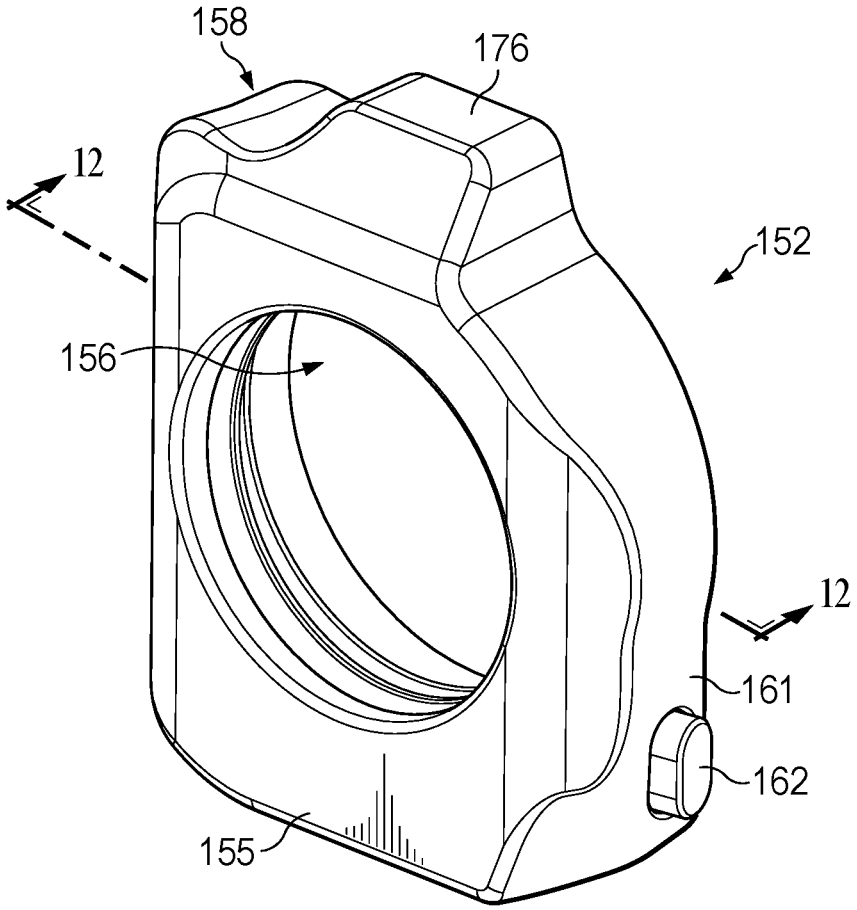
FIG. 11 is a perspective view of a bottom side of the collar of FIG. 8.

FIG. 7 shows the lock recess 136 in additional detail. The lock recess 136 has an asymmetric shape in both a lateral direction (side to side in the figure) and a rear/front direction (up and down in the figure), as well as along any other orientation. This dual asymmetrical shape of the lock recess 136 may prevent installation of a collar of a lock assembly into the lock recess 136 in an incorrect orientation. That is, a collar having a shape profile corresponding to the lock recess 136 will only fit into the lock recess in the proper orientation. Further, the irregular horizontal profile of the lock recess 136, lacking a plane of symmetry, may help retain a collar therewithin and prevent rotation of the collar when subjected to torque about an axis of the passage 110. The lock recess 136 is defined by a front wall 137 and an opposing rear wall 139 with a notch 138 extending forward from the front wall away from the rear wall. A sidewall 140 and an opposing sidewall 141 are oriented substantially perpendicular to the rear wall 139. Although not shown, a pocket may be formed into each of the sidewalls 140 and 141, each pocket extending laterally outward from the lock recess 136 in a direction substantially perpendicular to the respective sidewall 140 or 141. The pocket in the sidewall 140 may be disposed nearer to the rear wall 139 and the pocket in the sidewall 141 may be disposed nearer to the front wall 137. A curved wall 142 extends between the front wall 137 and the sidewall 140, a curved wall 143 extends between the sidewall 140 and the rear wall 139, a curved wall 144 extends between the rear wall 139 and the sidewall 141, and a curved wall 145 extends between the sidewall 141 and the front wall 137. In the illustrated example, each of the curved walls 142-145 has a different radius of curvature which may further aid in proper orientation of a collar during installation into the lock recess 136. Curved wall 142 may have a radius identical to or similar to the radius of the passage 110, whereas the curved walls 143-145 may have smaller radii. The lock recess 136 is defined by an upper surface 146, through which the passage 110 extends. In some examples, the upper surface 146 is perpendicular to the central axis of the passage 110.

FIGS. 8-12 illustrate a collar 152 of the lock assembly 106 configured to be received within the lock recess 136. The collar 152 includes a top surface 154 and an opposing bottom surface 155 which may be parallel to or angled with respect to one another. Extending between the top surface 154 and bottom surface 155 are a front side 158, a rear side 159, and opposing side surfaces 160 and 161. A protrusion 176 extends outward along the front side 158 of the collar. A bore 156 extends through the collar 152 from the top surface 154 to the bottom surface 155 along a central axis 157. At least a portion of the bore may be threaded with threads 166.

A pin detent 164 that is biased radially inward may be positioned within a correspondingly shaped recess extending radially outward from the bore 156 toward the protrusion 176. The pin detent 164 includes a flexible member 168 having a wedge shape and a prong 170 extending therefrom. The flexible member 168 may be formed from a resilient material, such as a rubber or polymer to exert a biasing force on the prong 170 when compressed, and the prong 170 may be formed from a rigid material, such as steel or another metal. The prong 170 is partially embedded within the flexible member 168 to bond the two together and extends through an outer surface thereof radially inward toward the central axis of the bore 156. The prong 170 may be positioned adjacent an end of the threads 166 nearest the top surface 154 with a tip of the prong extending into the bore 156.

An installation detent 162 that is biased outward from the collar 152 extends from each of the side surfaces 160 and 161 of the collar 152. Each installation detent 162 includes a flexible member 172 and a rigid member 174. The flexible member 172 may be formed from a resilient material, such as a rubber or polymer, and the rigid member 174 may be formed from steel or another metal. The rigid member 174 may have a stem or other extension (not shown) that is embedded within the flexible member 172 to bond the rigid member 174 to the flexible member 172. The installation detents 162 may be positioned within correspondingly shaped pockets extending into the collar 152 from the side surfaces 160 and 161 such that the flexible member 172 is fully disposed within a pocket and the rigid member 174 is at least partially disposed outside the pocket. The flexible members 172 may have a width dimension that is less than a corresponding width of the pocket to allow the flexible member 172 to be compressed and deformed within the pocket when the rigid member 174 is pressed inward toward the pocket.

Figure 12:
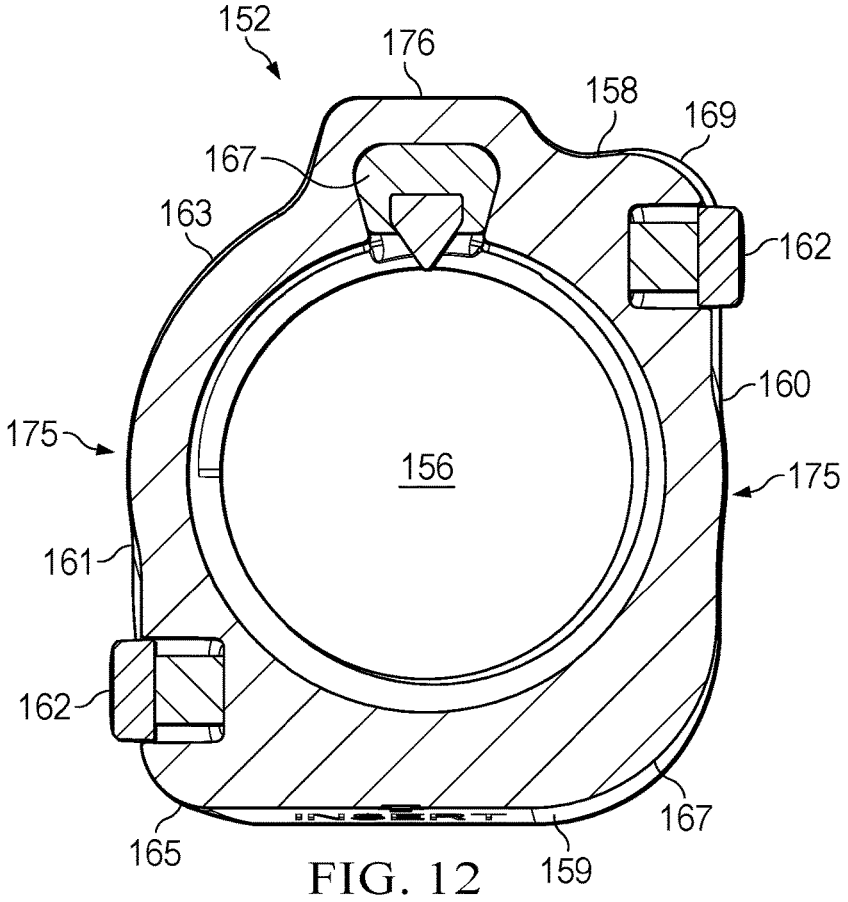
FIG. 12 is a cross-section view of the collar of FIG. 8.

As shown in the cross-section of FIG. 12, the collar 152 has a size and shape closely corresponding to the lock recess 136 of the shroud. The curved surfaces 163, 165, 167, and 169 have radii identical to or slightly small than the radii of the corresponding curved walls 142, 143, 144, and 145, respectively, of the lock recess 136. Each of the curved walls 142, 143, 144, and 145 and each of the curved surfaces, 163, 165, 167, and 169 has a profile formed as a minor arc. That is, each curve extends less than 180°. In some examples, curved walls 143 and 144 and corresponding curved surfaces 165 and 167 may extend 90° or less before intersecting the respective adjacent surface on each end. In contrast, curved walls 142 and 145 and corresponding curved surfaces 163 and 169 may extend 90° or more.

During use, the collar 152 may be subjected to substantial loading during use of the shroud 104. In this regard, the collar 152 must be sufficiently stout to accommodate the loads without breaking or plastically deforming. In this regard, the collar 152 may have a minimum wall thickness around its perimeter as may be calculated based on design loads and the material used in construction of the collar, e.g., steel. Because the installation detents 162 and pin detent 164 are positioned within recesses or pockets formed into the wall of the collar, those recesses form voids detracting from the thickness of the wall. Accordingly, the collar 152 may have a circumferential profile around the bore 156 that is greater in regions housing the detents 162 and 164 to provide the minimum wall thickness even in those regions. That is, the region forming the protrusion 176 houses the pin detent 164 and is accordingly extended outward at the front side 158 to provide a sufficient thickness of material between the pin detent 164 and the outer surface of the collar. Similarly, the regions adjacent the curved surfaces 165 and 169 house the installation detents 162 and are extended outward away from the bore 156 to provide a sufficient thickness of material between the installation detents 162 and the bore 156. Also, a bulge 175 may be formed along each lateral side surface 160 and 161, providing the minimum wall thickness around the bore 156. Bulge 175 on side surface 161 is formed as a portion of the curved surface 163. The lock recess 136 includes indentations within the walls corresponding in size and shape to receive the bulges 175. In some examples, the side surfaces 160 and 161 may be spaced further apart, providing the minimum wall thickness without inclusion of one or both bulges 175.

Figure 13:
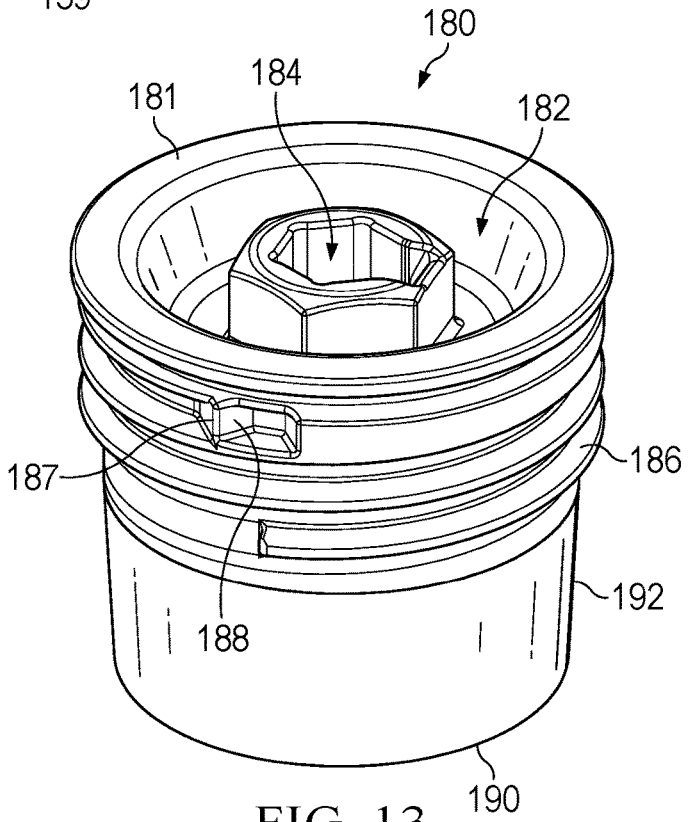
FIG. 13 is a perspective view of an example of a pin according to the present disclosure.

FIG. 13 illustrates a pin 180 of the lock assembly 106. A head 181 defines a top of the pin 180 and a tip 190 defines a bottom of the pin with a shaft 192 extending between the head 181 and the tip 190. A post 182 is positioned centrally within a recess formed into the top of the pin 180. The post 182 has a hexagonal outer profile configured to be engaged by a socket for rotation of the pin about its longitudinal central axis during installation or removal of the pin. A hexagonal recess 184 is formed into the post 182 and is configured to receive a hex wrench as an alternative method of rotating the pin 180. Helical threads 186 corresponding to the threads 166 of the collar 152 are formed around the outer circumference of the shaft 192. An indentation 188 is formed into the shaft 192 at an upper terminal end of the threads 186 adjacent to the head 181. The indentation 188 may be formed along the helical path of the threads 186 and separated from the threads 186 by a ridge 187 extending across the channel of the threads. The indentation 188 may have a size and shape corresponding to the prong 170 of the pin detent of the collar 152. In the illustrated example, the prong 170 and the indentation 188 have a triangular shape. It will be appreciated that in some examples, the pin detent 164 may be housed in the pin 180 and the indentation 188 may be formed within the collar 152. Further, in some examples, the indentation 188 may be formed at the lower terminal end of the threads 166 or 186 rather than the top.

Figure 14:
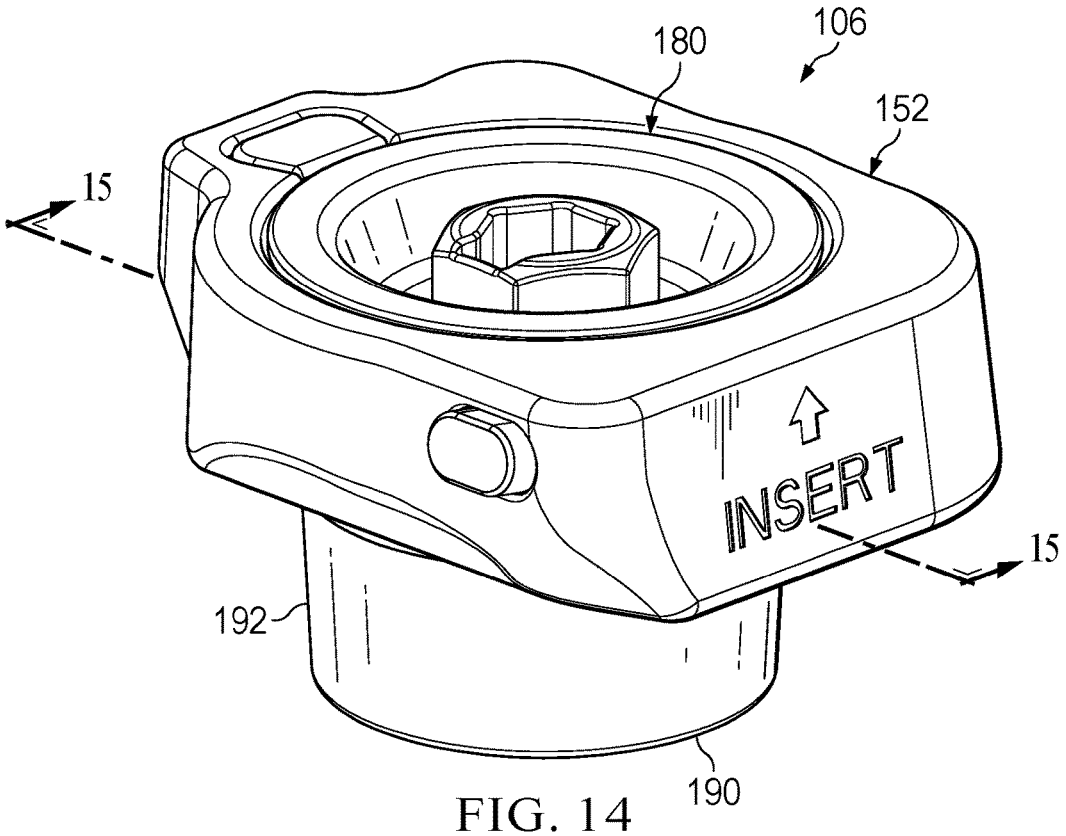
FIG. 14 is a perspective view of an example of a lock assembly according to the present disclosure.
Figure 15:
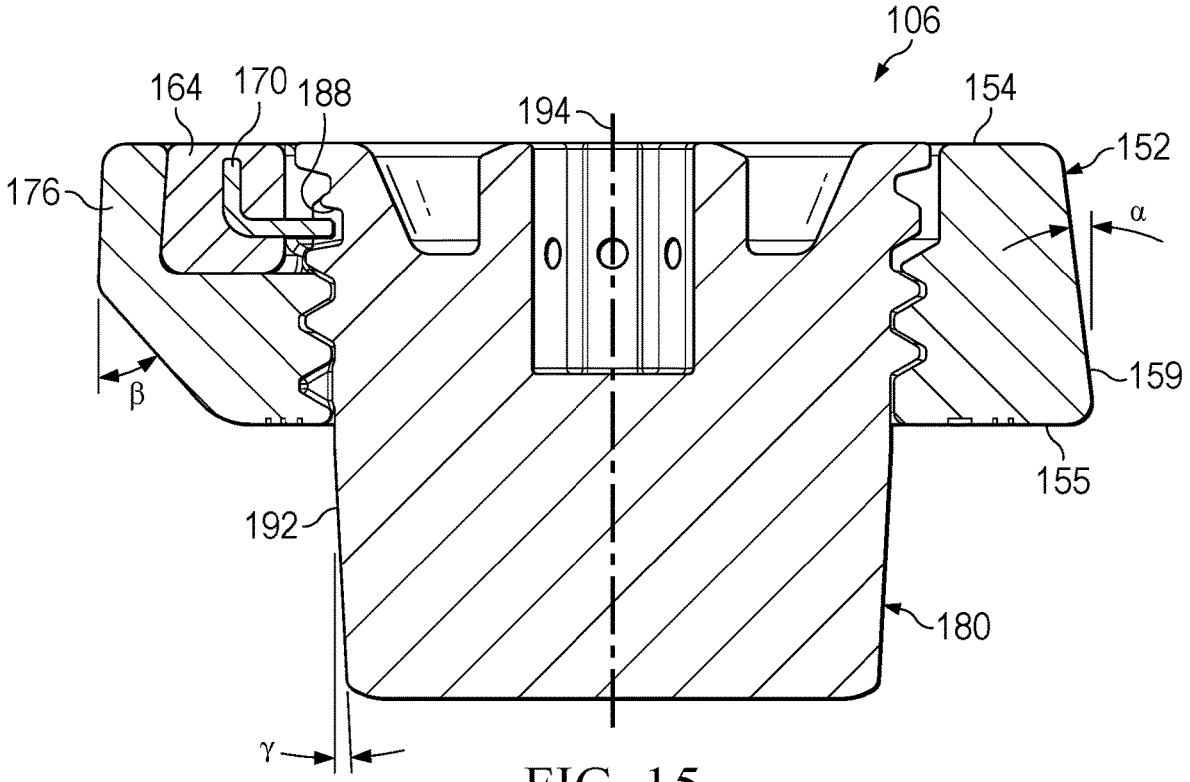
FIG. 15 is a cross-section view of the lock assembly of FIG. 14.

FIGS. 14-15 illustrate the lock assembly 106 in an assembled configuration. Assembly of the lock assembly 106 may include inserting the tip 190 of the pin 180 through the bore 156 in the collar 152 from the top surface 154 and past the bottom surface 155. As the bottom edge of the threads 186 of the pin 180 engage the top edge of the threads 166 of the collar 152, the pin 180 may be rotated about its central axis 194 to thread the pin 180 into the collar 152. The prong 170 may ride along the channel formed between adjacent threads 186. As the pin 180 nears a fully seated configuration, the prong 170 engages the ridge 187 in the channel, compressing and deforming the flexible member 168 as the prong 170 slides up a ramped surface on one side of the ridge 187 thereby biasing the prong 170 radially toward the pin 180. Upon reaching the fully seated or locked configuration of the pin 180 in the collar 152 as illustrated, the pin detent 164 may at least partially decompress as the prong 170 slides down a ramped surface of the ridge 187 and snaps into the indentation 188 in the pin 180. Snapping of the prong 170 into the indentation 188 may provide a user with haptic feedback confirming the pin 180 is fully seated. Engagement of the pin detent 164 with the indentation 188 may also resist rotation of the pin 180 during use as a substantial rotational force is required to compress the flexible member 168 to remove the prong 170 from the indentation 188. Because typical use of the shroud assembly is unlikely to impart such a rotational force, the engagement of the pin detent 164 with the indentation 188 aids in preventing inadvertent back-out (or unlocking) of the pin 180.

One or more of the outer surfaces of the collar 152 may be tapered or otherwise angled with respect to the top surface 154 and/or bottom surface 155. As shown in FIG. 15, the rear side 159 of the collar 152 is angled outward from the top surface 154 toward the bottom surface 155 forming an angle $\alpha$ with respect to the central axis 194. The upper portion of the protrusion 176 may have a similar angle with respect to the central axis 194 or may be parallel thereto. Similarly, the side surfaces 160 and 161 of the collar may be vertical or may have an angle similar to $\alpha$. The front wall 137, rear wall 139, and sidewalls 140 and 141 of the lock recess 136 may be tapered in manner corresponding to the respective outer surfaces of the collar 152 which may improve ease of installation of the collar 152 into the lock recess 136, help distribute stresses between the collar 152 and the shroud 104 during loads imposed during use, and may help retain the collar 152 in the lock recess 136. A lower portion of the protrusion 176 may be angled more steeply than the upper portion of the protrusion, forming an angle $\beta$ with respect to the central axis 194. The shaft 192 of the pin 180 is tapered at an angle $\beta$ with respect to the central axis 194 with the head 181 being wider than the tip 190.

Figure 16:
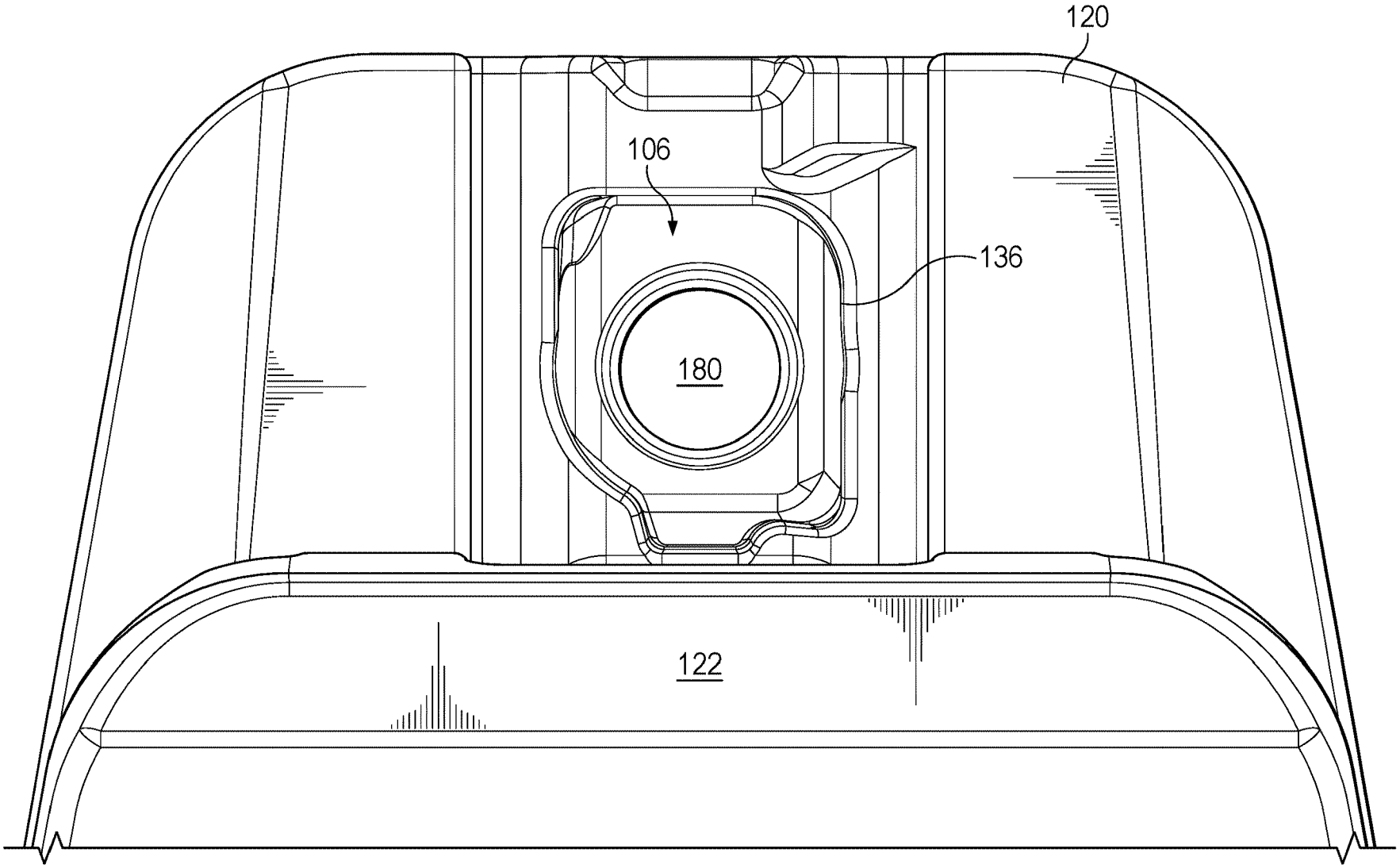
FIG. 16 is a bottom view of a shroud with a lock assembly positioned therein.

FIG. 16 shows a bottom view of the shroud 104 with the lock assembly 106 installed in the lock recess 136 in the upper leg 120 of the shroud.

Figure 17:
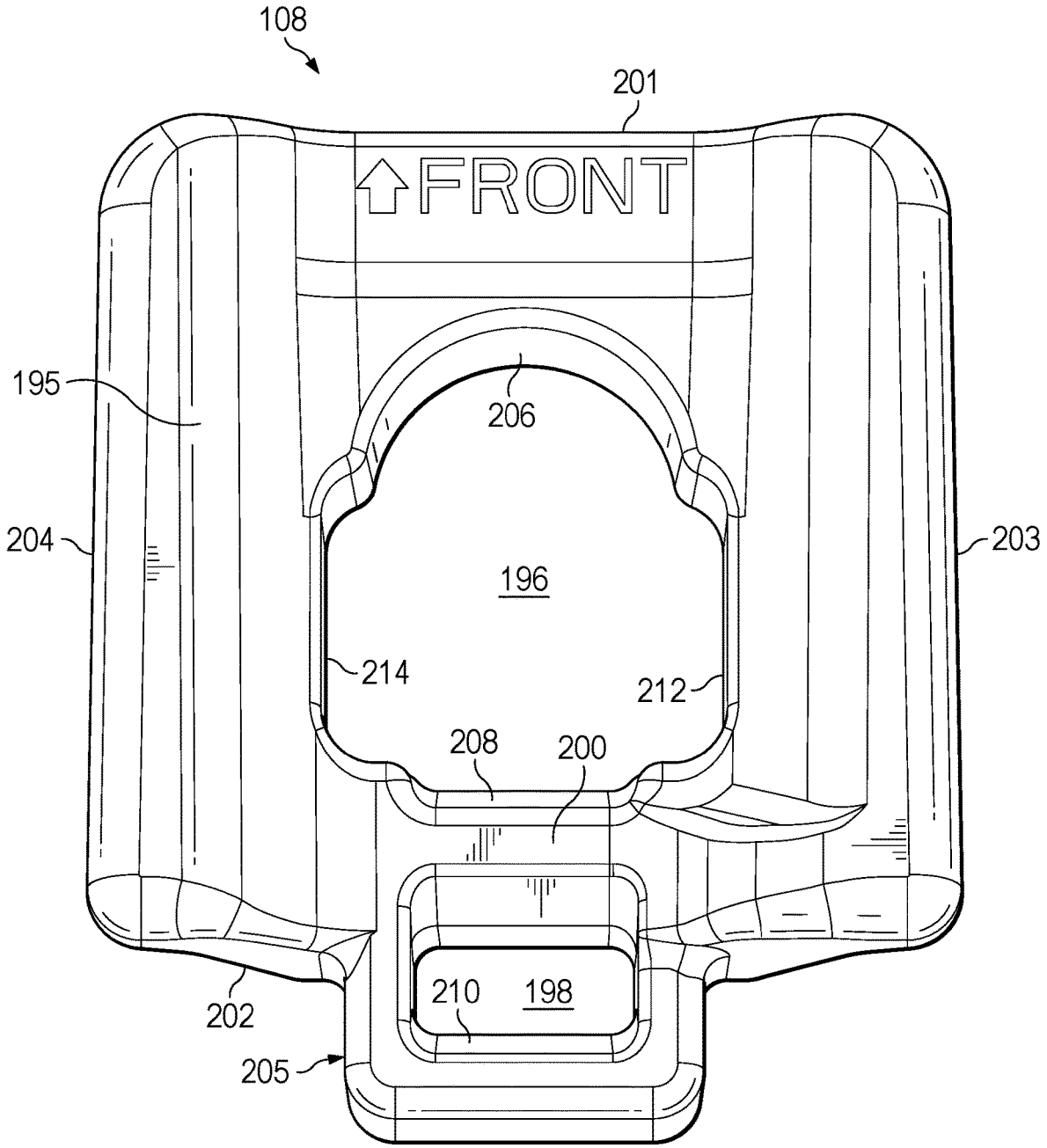
FIG. 17 is a top view of an example of a fixation base according to the present disclosure.
Figure 18:
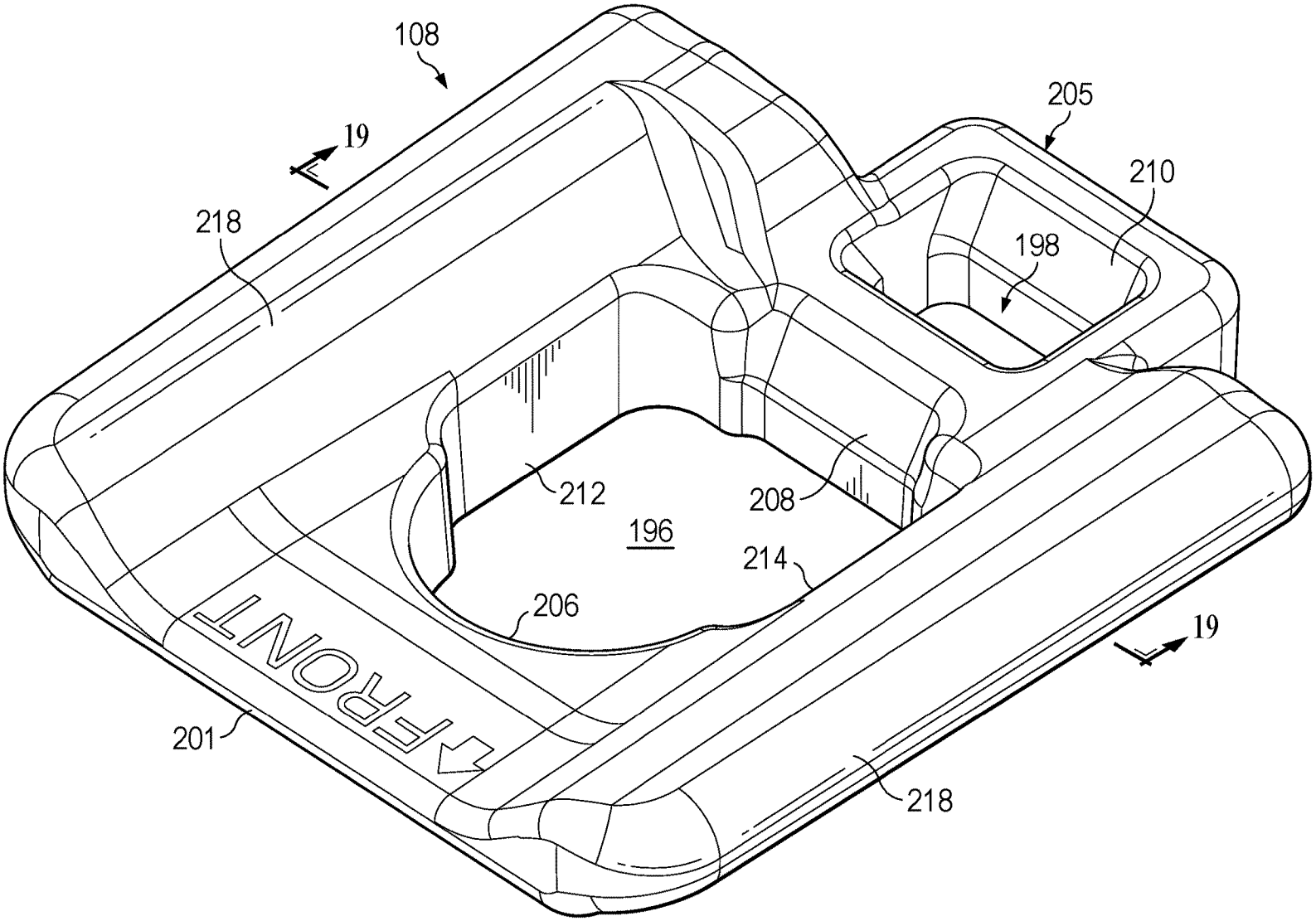
FIG. 18 is a perspective view of the fixation base of FIG. 17.
Figure 19:
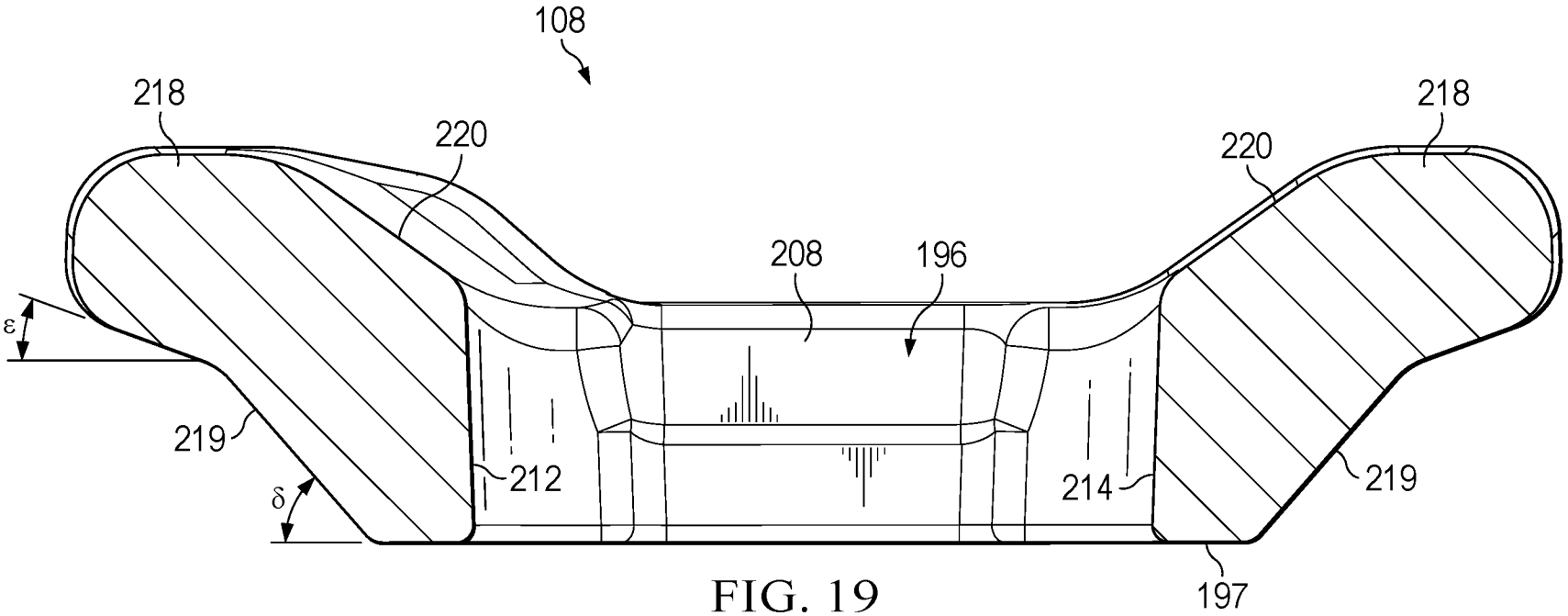
FIG. 19 is a cross-section of the fixation base of FIG. 17.

FIGS. 17-19 show a fixation base 108 to which the shroud 104 may be attached using the lock assembly 106. The shroud 108 has a top side 195 and a bottom surface 197 that is configured to be secured to a bucket lip. A central opening 196 extends through the fixation base 108 from the top side 195 to the bottom surface 197. A rear opening 198 is positioned rearward of the central opening 196 and also extends from the top side 195 to the bottom surface 197. A lateral wall 200 defines a rear of the central opening 196 and separates the central opening 196 from the rear opening 198, although in some examples the rear opening 198 may be formed as part of the central opening 196. The fixation base extends from a front side 201 to a rear side 202 and from a lateral side 203 to a lateral side 204. An extension 205 extends rearward from a central portion of the rear side 202, forming at least a portion of the rear opening 198.

The central opening 196 is enclosed laterally by sidewall 212 and sidewall 214. A front side of the central opening 196 is defined by a lock wall 206, at least a portion of which is shaped and sized in a manner corresponding to the shape and size of the shaft 192 of the pin 180. When the shroud 104 is secured to the fixation base 108 with the lock assembly 106, the portion of the shaft 192 near the tip 190 engages the lock wall 206 and the tip 190 of the pin 180 engages the bucket lip or is positioned near the bucket lip within the central opening 196. The lock wall 206 is tapered in manner similar to the shaft 192 at an angle equal to or slightly greater than a. In one example, a is approximately 3° and the lock wall 206 is approximately 4°. It will be appreciated that one or both of the shaft 192 and the lock wall 206 may have steeper or shallower angles with respect to the central axis 194, for example, in a range of approximately 0-10°.

A pry surface 208 is formed on the lateral wall 200 and a pry surface 210 is formed on a rear portion of the extension 205. The pry surfaces 208 and 210 are angled with respect to a top surface of the lateral wall 200 and extension 205 to facilitate access into the central opening 196 and rear opening 198 with a pry bar or other tool during removal of the shroud 104 and may provide a fulcrum for prying the shroud forward.

An outer surface 219 of each of the sidewalls 212 and 214 may be angled laterally outward and upward from the bottom surface 197 at an angle δ, which in some examples is approximately 45°, although it should be appreciated that surfaces 219 may be vertical or may be angled at any suitable angle with respect to the bottom surface. An inner surface 220 of each sidewall 212 and 214 extending outward from the central opening 196 may parallel to the outer surface 219. In the illustrated example, the inner surfaces 220 have a shallower angle than 6 with respect to the bottom surface 197. The outer surface 219 and inner surface 220 of each sidewall extends to a wing 218 formed on each lateral side of the fixation base 108. The wings 218 extend laterally outward and upward away from the central opening 196. The wings 218 are sized and shaped to be received in the slots 128 of the shroud 104 and to engage one or more surfaces forming the slots 128. The wings 218 may be substantially parallel or otherwise angled with respect to one another in a manner corresponding to the slots 128. In some examples, the wings 218 angle outward toward the rear side 202 of the fixation base 108 to facilitate ease of installation and removal of the shroud 104. A bottom surface of each wing 218, disposed laterally outward from the outer surfaces 219 of the sidewalls 212 and 214, may be horizontal or may be angled with respect to the bottom surface 197 of the fixation base 108 at an angle ε, which may be approximately 10-45°, preferably about 20°. Having the wings angled upward in this manner may facilitate access with a welder to weld the fixation base 108 to a bucket lip around an outer perimeter of the bottom surface 197. The vertical profile of the fixation base 108 may include a depression in between the wings 218 as can be seen in FIG. 19. This depression may accommodate the lowered central region 130 of the shroud 104.

Figure 20:
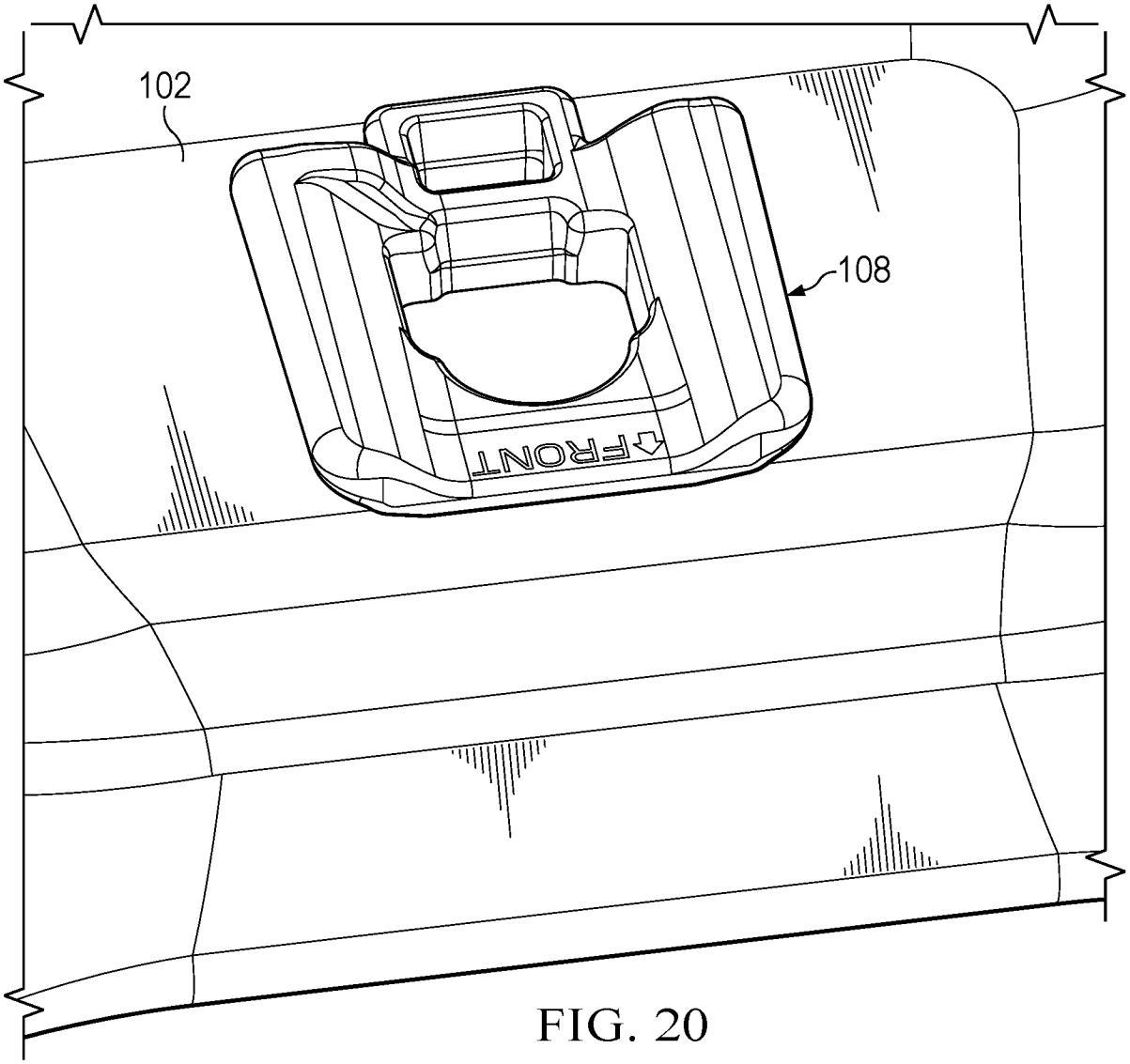
FIG. 20 is a perspective view of an example of a fixation base positioned on a bucket lip according to the present disclosure.

FIG. 20 illustrates the fixation base 108 secured to a bucket lip 102. Typically, the fixation base 108 is secured to the bucket lip 102 by welding, although it is contemplated that a fastening mechanism may be used to secure the fixation base 108 to facilitate removal and replacement of the fixation base. As illustrated, the fixation base 108 is welded to a top surface of the bucket lip 102, which may also be described as "within" or "inside" the bucket. However, it will be appreciated that a fixation base 108 may be positioned at any suitable location on the bucket lip 102, including on a bottom side or "outside" of the bucket, for securing a wear member in a desired location.

Figure 21:
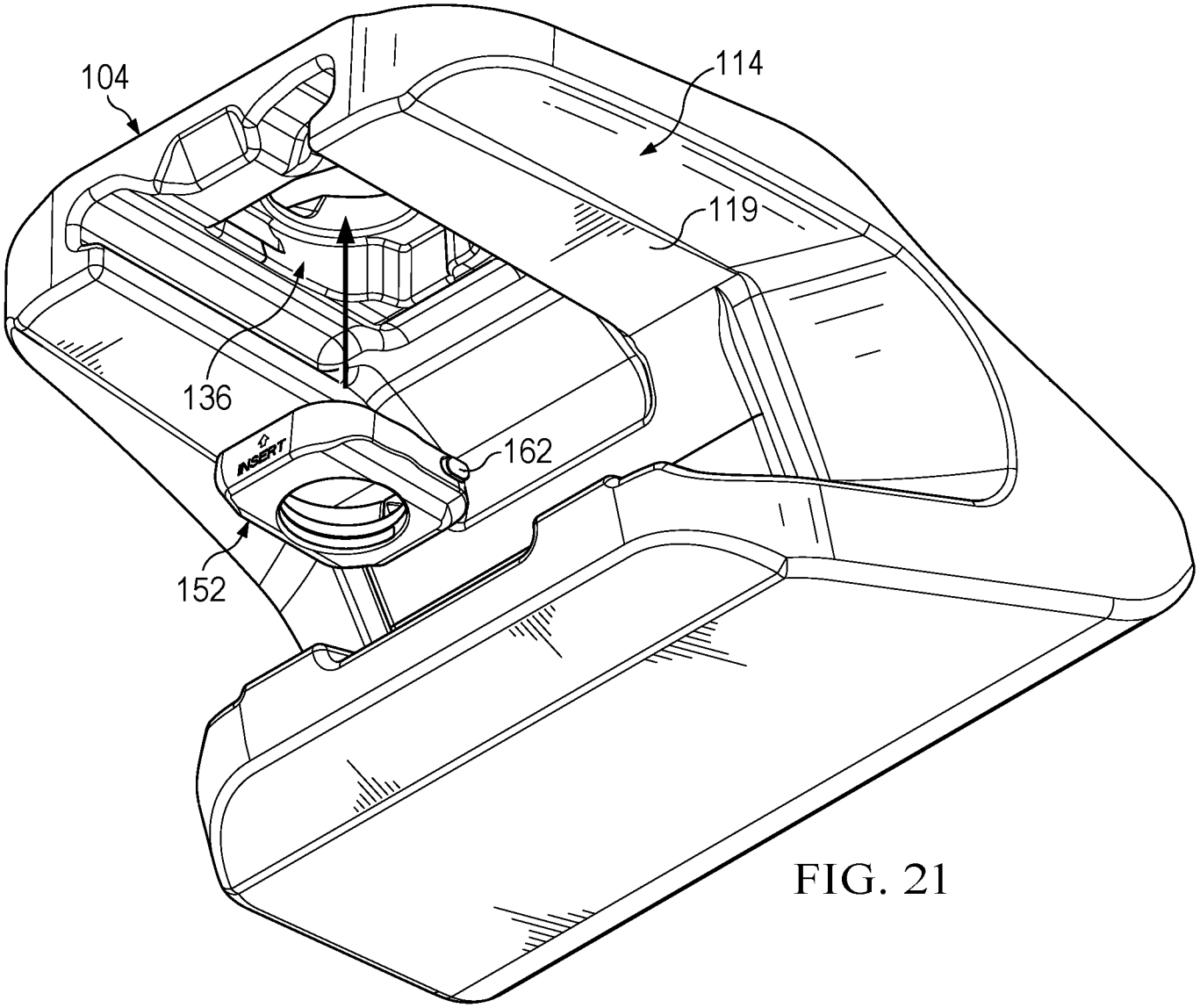
FIGS. 21-24 are perspective views of assembling a lip shroud assembly according to an example of the present disclosure.

FIGS. 21-24 illustrate various stages of assembly of a shroud assembly. Initially, as shown in FIG. 21, a collar 152 is installed in the lock recess 136 of the shroud 104. The collar 152 is raised upward into the lock recess 136 from the channel 114. The sidewalls 140 and 141 of the lock recess 136, may compress the installation detents 162 on the collar 152 as the collar is slid into place. Upon reaching the fully seated position in which the top surface 154 of the collar 152 is in contact with or nearly in contact with the upper surface 146 of the lock recess 136, the installation detents 162 snap into place in the pockets formed into the sidewalls 140 and 141 of the lock recess 136. It will be appreciated that the installation detents could be installed into the lock recess 136 and the pockets could be formed into the collar 152. Once snapped into place, the installation detents span across the interface between the side surfaces 160 and 161 of the collar 152 and the sidewalls 140 and 141 of the lock recess 136, retaining the collar 152 within the lock recess 136 in the shroud 104. This process of installing the collar 152 into the shroud 104 may occur at the time of installing the shroud 104 onto a bucket lip or may occur at any time prior such as before shipping of the shroud 104. In this regard, the collar 152 including the installation detents 162 and the pin detent 164 may be assembled with the shroud 104 contemporaneously with manufacturing of the shroud 104.

Figure 22:
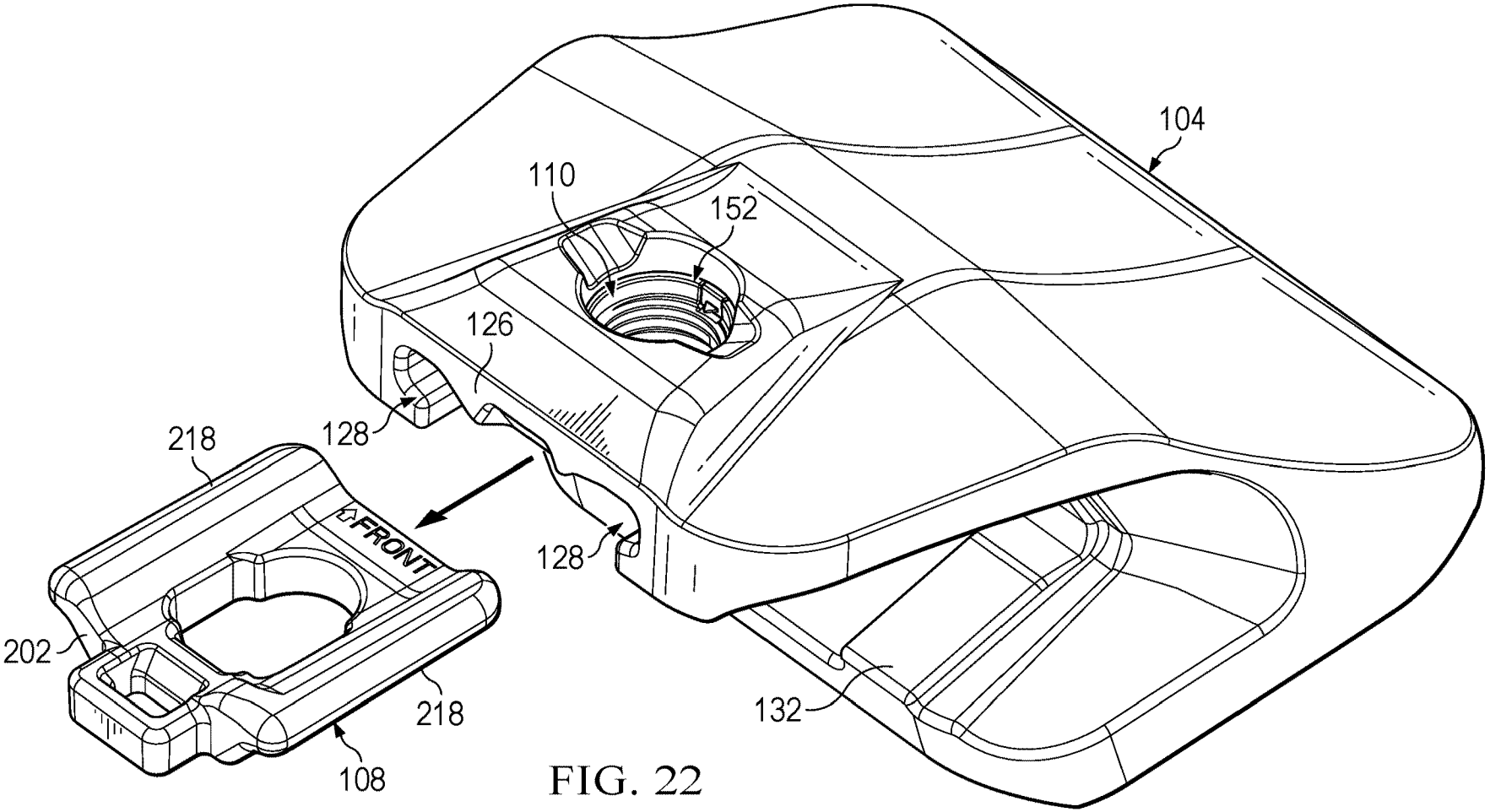
Figure 23:
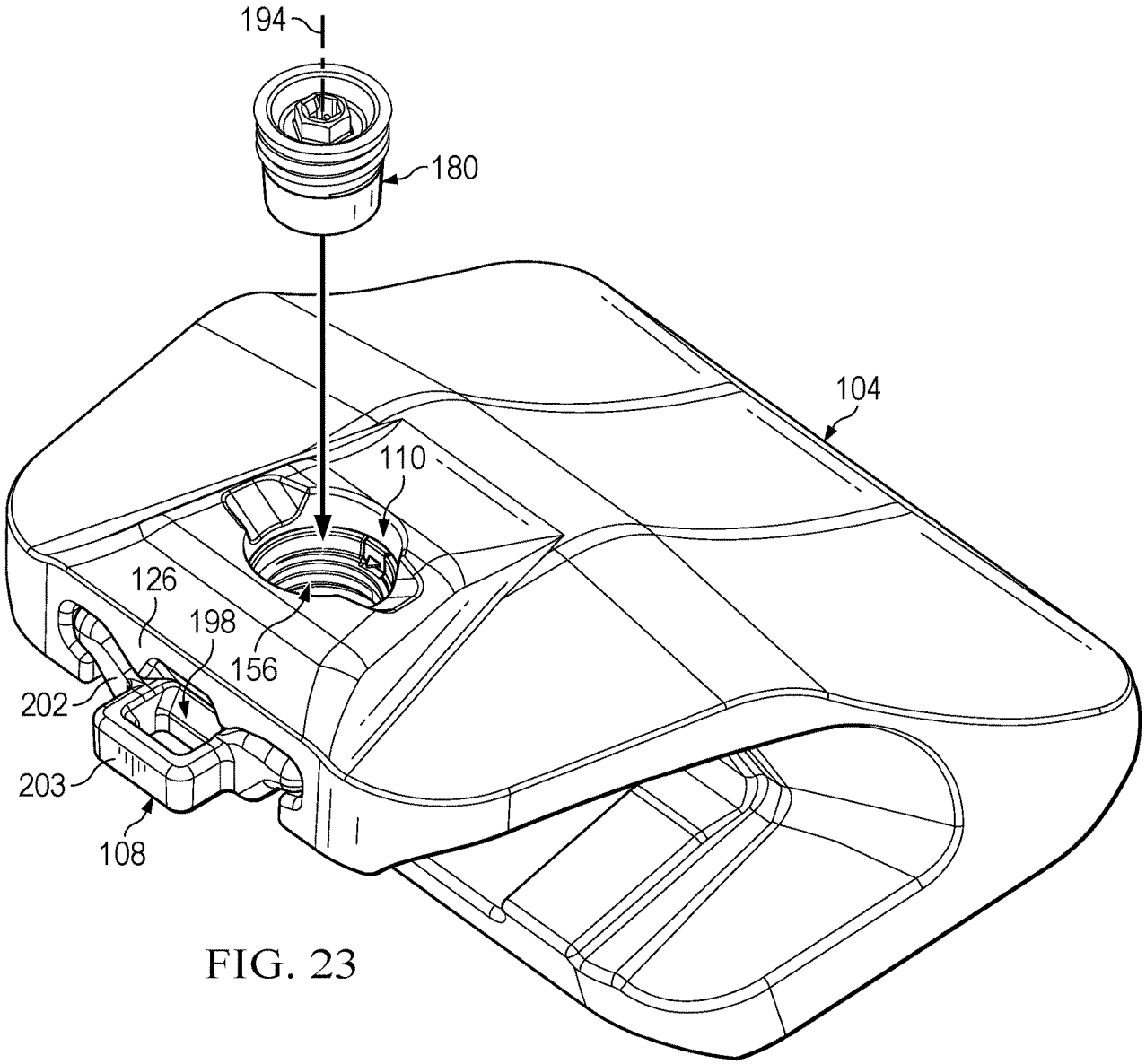
Figure 24:
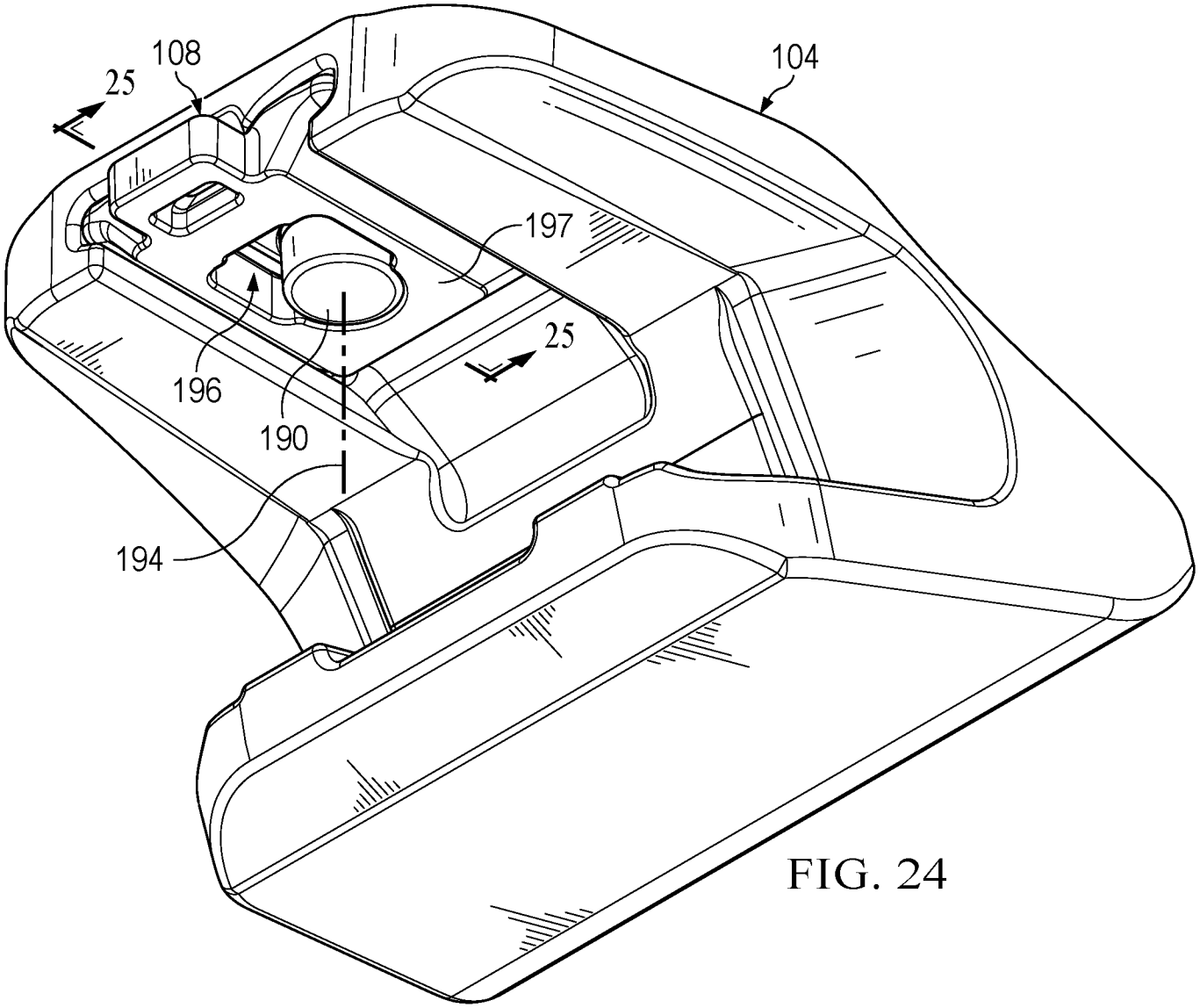

The shroud 104 may then be slid rearward onto the fixation base 108 as shown in FIG. 22. The slots 128 extending forward from the rear surface 126 of the shroud receive the wings 218 of the fixation base 108. In examples in which the top surface and bottom surface of the bucket lip are not parallel (e.g., the top surface of the lip is angled upward away from the front edge of the bucket lip), the fixation base 108 will generally be parallel to the top surface but not the bottom surface. In this regard, the wings 218 may be angled upward. As the shroud 104 is slid onto the fixation base 108, the ribs 132 on the lower leg 122 of the shroud 104 may be drawn upward into contact with or adjacent to the bottom surface of the bucket lip. The shroud 104 is slid rearward until the contact pads on the shroud engage the bucket lip. In this installed configuration as shown in FIG. 23, the rear surface 126 of the shroud is generally aligned with the rear side 202 of the fixation base. The extension 205 of the fixation base, including the rear opening 198, remains exposed behind the rear surface 126 of the shroud 104. In this installed configuration, the passage 110 of the shroud 104 and the bore 156 of the collar 152 are aligned along a common axis which is aligned with a corresponding portion of the central opening 196 of the fixation base 108 for proper installation of the pin 180. As the pin 180 is inserted into the passage 110 and threaded into the bore 156 with the central axis 194 of the pin 180 aligned with the common axis of the passage and bore, the tip 190 of the pin 180 is advanced into the central opening 196 in the fixation base, as shown in FIG. 24.

Figure 25:
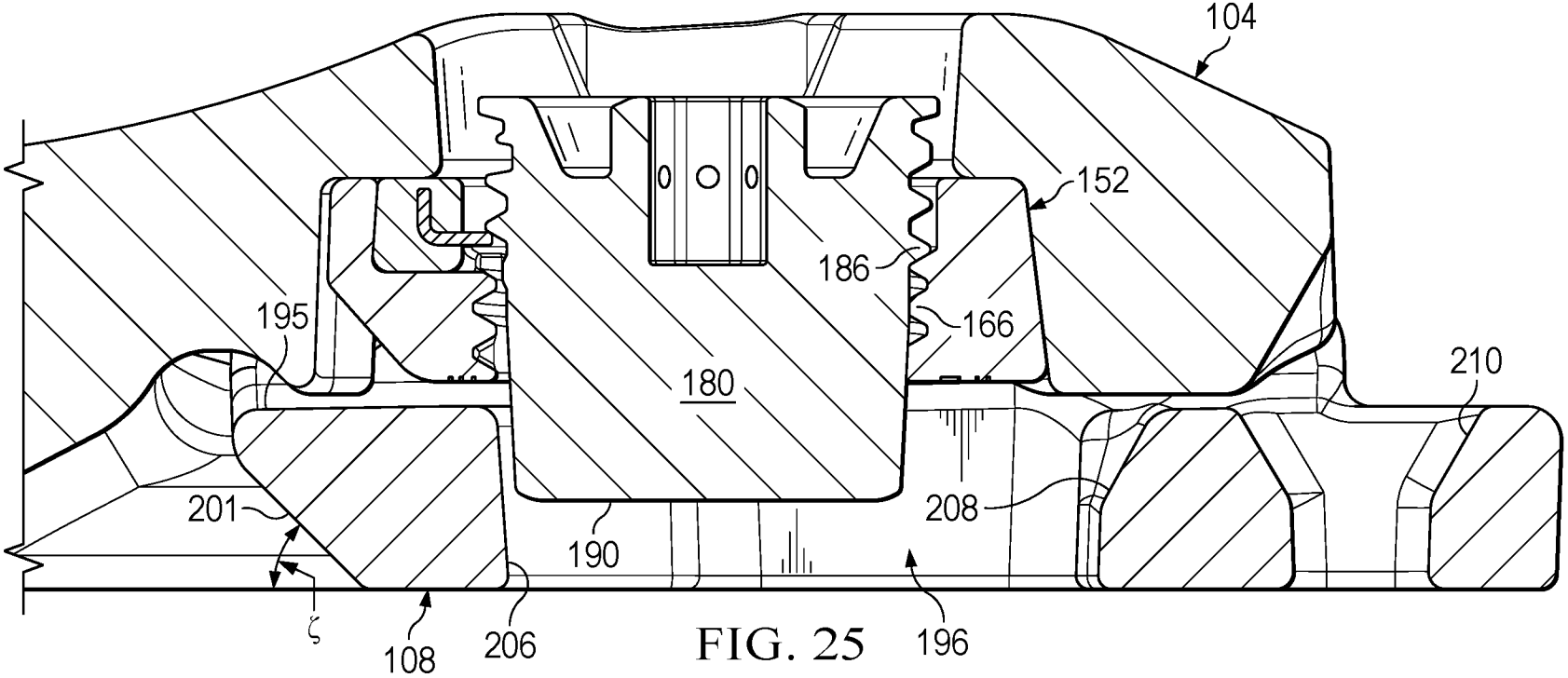
FIGS. 25-26 are cross-section views of installing a pin in a lip shroud assembly according to an example of the present disclosure.
Figure 26:
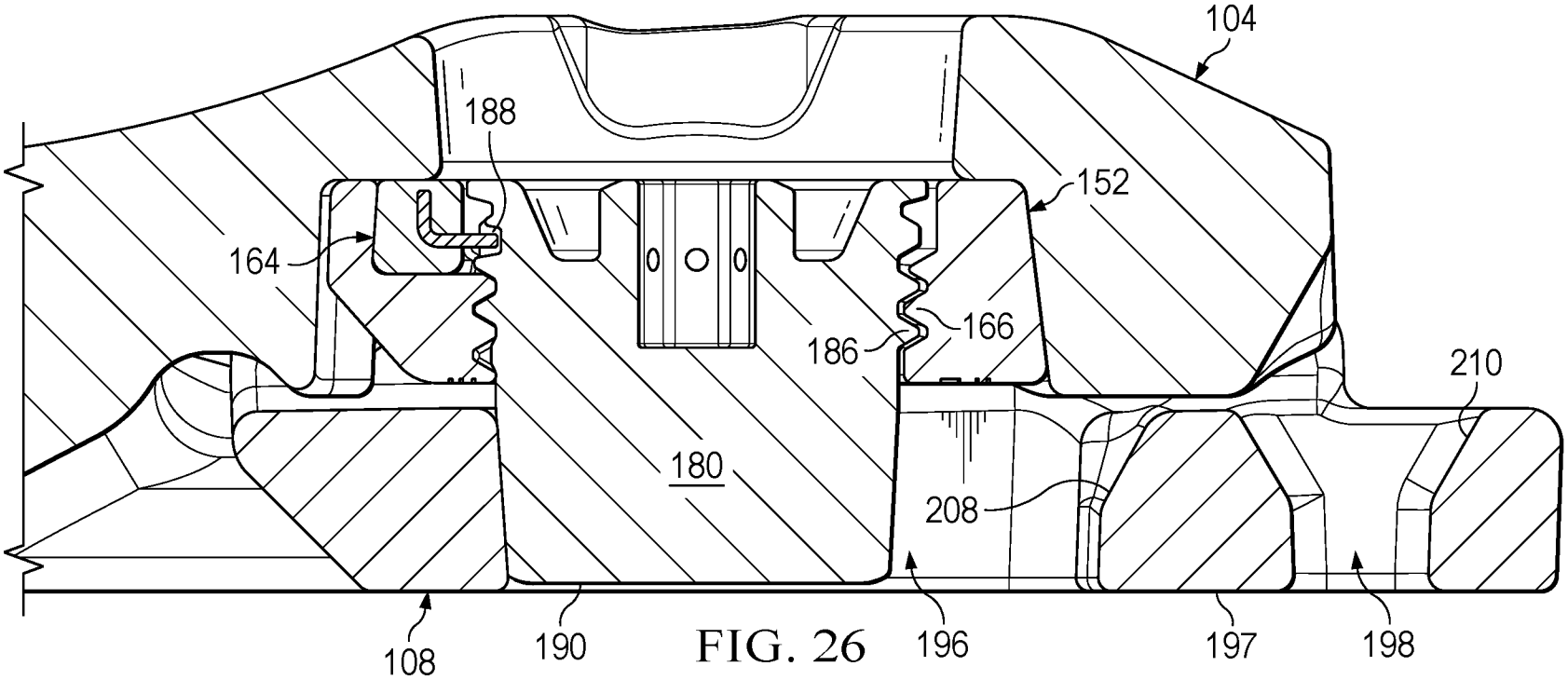

FIGS. 25 and 26 show cross sections of the shroud assembly as the pin 180 is advanced during installation. Initially, as shown in FIG. 25, the tip 190 of the pin 180 extends into the central opening 196 of the fixation base 108 prior to the threads 186 on the pin 180 engaging the threads 166 of the collar 152. However, the pin 180 may not yet be in contact with the fixation base 108. As the pin 180 is rotationally threaded into the collar 152, the tip 190 advances deeper into the central opening 196. Because the pin 180 is tapered, having a greater diameter near the head at the top than near the tip 190 at the bottom, as the pin is advanced its shaft 192 nears the lock wall 206 in the fixation base 108. Once the pin 180 is fully seated in the collar 152, the shaft is in contact with the lock wall 206 and the pin detent 164 is engaged with the indentation 188 in the pin 180, as shown in FIG. 26.

As will be appreciated, the interference caused by the pin 180 prevents the shroud 104 from being removed from the bucket lip in response to a force that would otherwise tend to pull the shroud forward with respect to the bucket lip, for example, as the bucket is moved rearward dragging the shroud along the ground. Such loading causes the shroud 104 to exert a forward force on the collar 152 which, in turn, transfers the force to the pin 180 which, in turn, transfers the force to the fixation base 108 via the lock wall 206.

While the rear or the extension 205 of the fixation base 108 may be vertical or substantially vertical, the front surface along the front side 201 of the fixation base 108 is angled with respect to the bottom surface 197 at an angle ζ, which may be approximately 20-50°.

Figure 27:
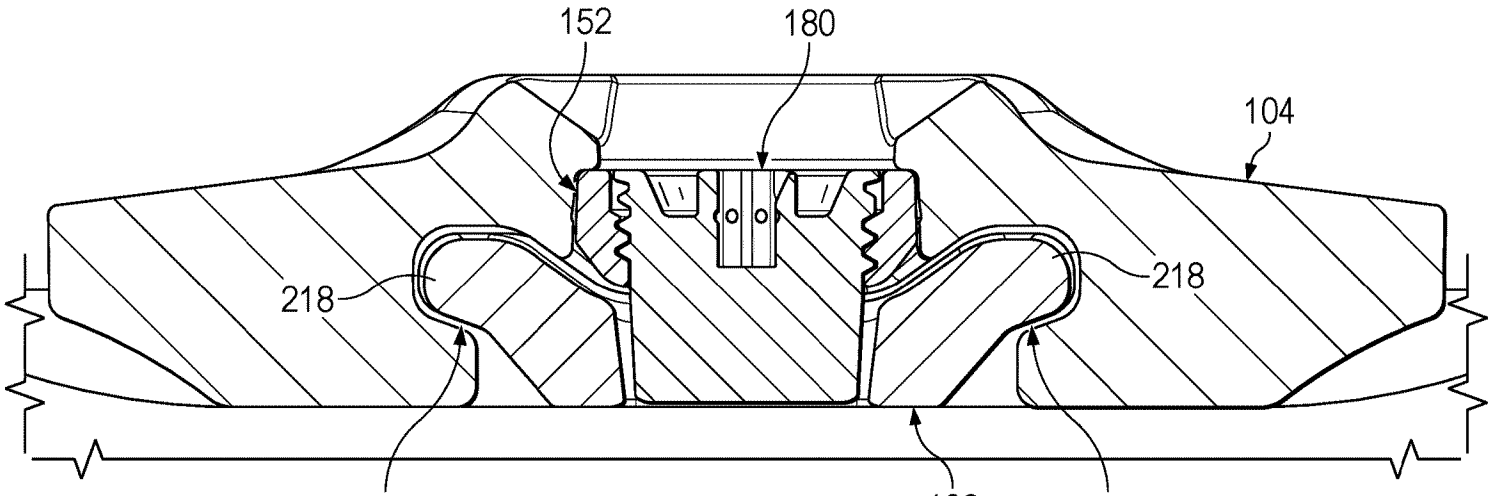
FIG. 27 is a cross-section view of an example of a lip shroud assembly according to the present disclosure.

FIG. 27 shows a cross section through the shroud assembly along a plane transverse to that of FIGS. 25 and 26, showing the wings 218 of the fixation base 108 positioned within the slots 128 of the shroud 104 when the shroud is fully installed with the lock assembly 106.

Figure 28:
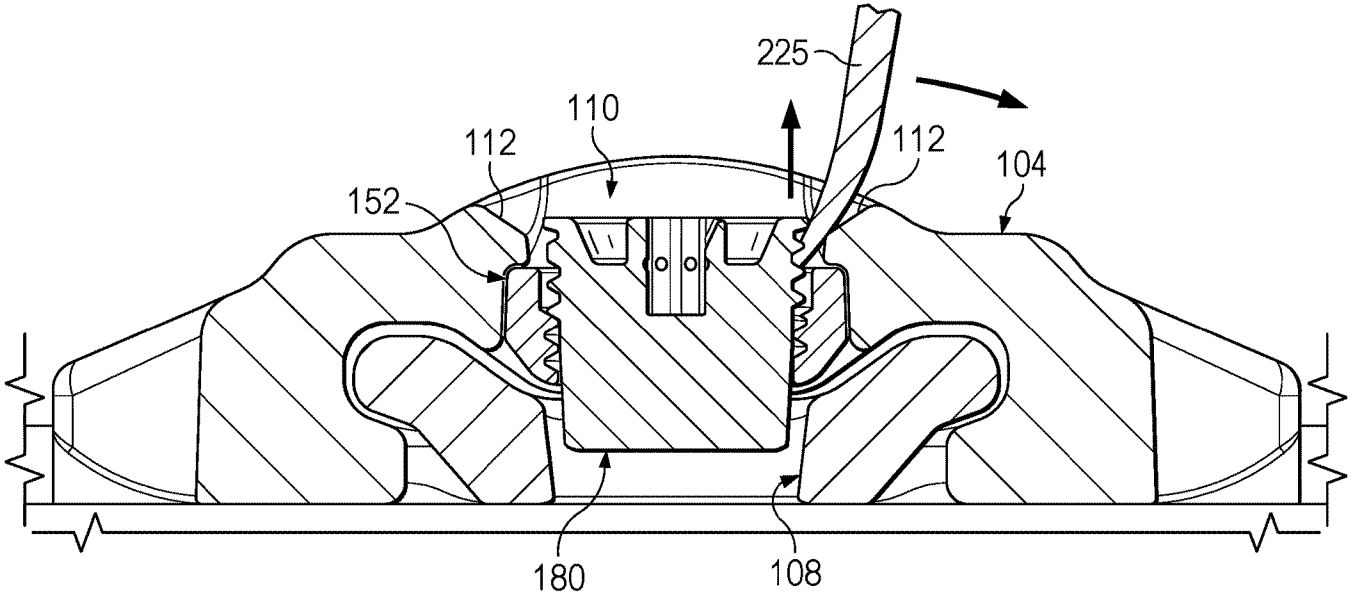
FIGS. 28-30 are cross-section views of disassembling a lip shroud assembly according to an example of the present disclosure.
Figure 30:
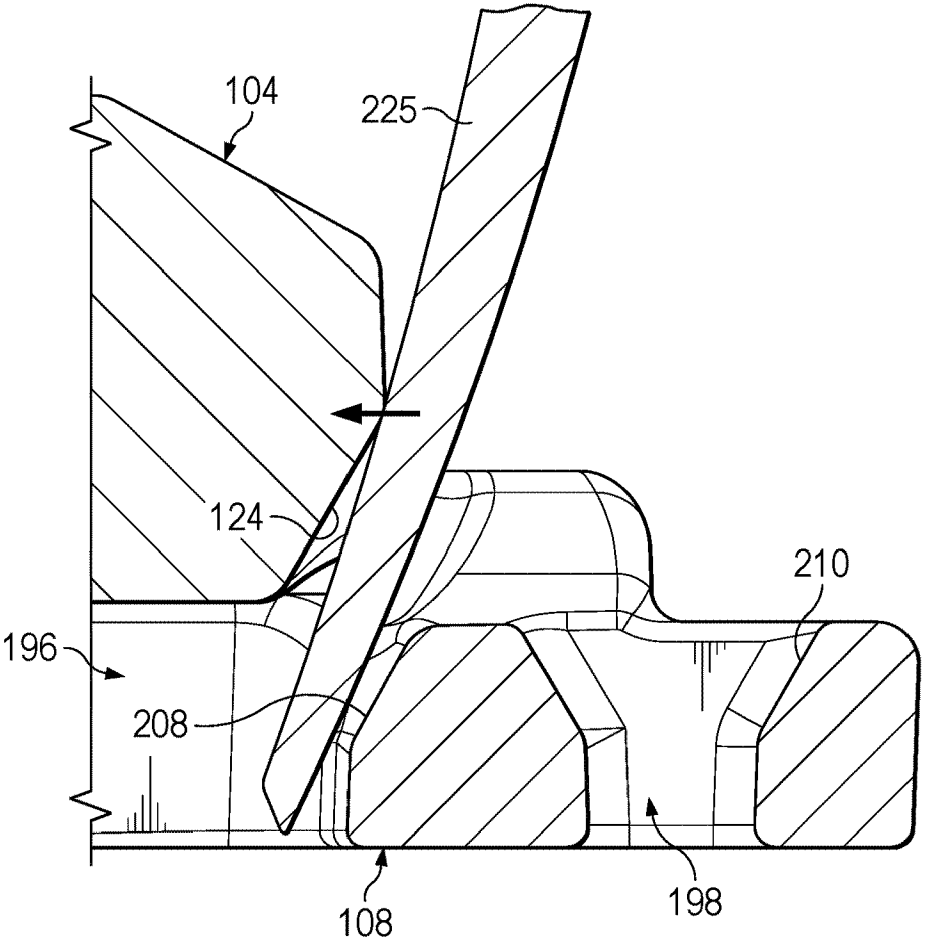
Figure 29:
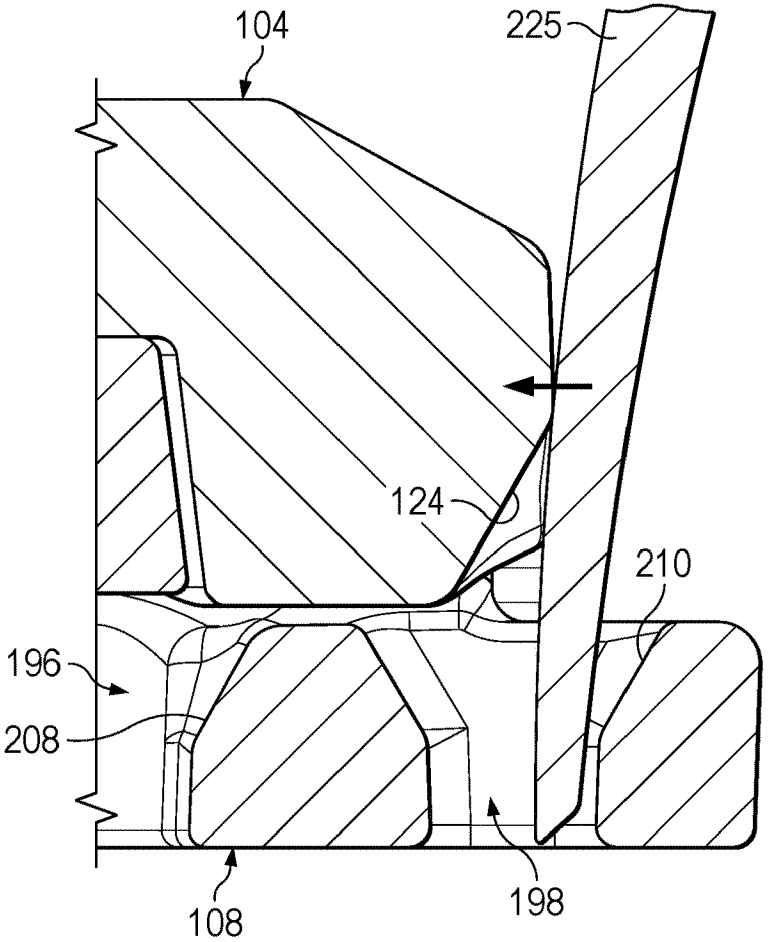

FIGS. 28-30 show various stages of removal of the shroud. Initially, the pin 180 is rotated in a direction opposite the direction of installation, thereby unthreading the pin 180 from the collar 152 back to the configuration shown in FIG. 25. As shown in FIG. 28, a pry bar 225 can then be inserted into the passage 110 of the shroud 104 along one of the pry surfaces 112. The pry bar 225 may be rotated about the pry surface to lift the pin out of the fixation base 108, the collar 152, and the shroud 104. With the pin 180 no longer interfering with forward movement of the shroud 104, the pry bar 225 may be inserted into the rear opening 198 of the fixation base 108. The pry surface 210 along the rear wall of the extension 205 may be used to pivot the pry bar 225 forward against the pry surface 124 at the rear of the shroud 104, thereby sliding the shroud 104 forward. Once the shroud 104 is slid forward far enough, the pry surface 208 on the lateral wall 200 may be exposed allowing the pry bar 225 to be inserted into the central opening 196. Again the pry bar 225 may be pivoted forward to further advance the shroud 104 off of the fixation base 108.

Figure 31:
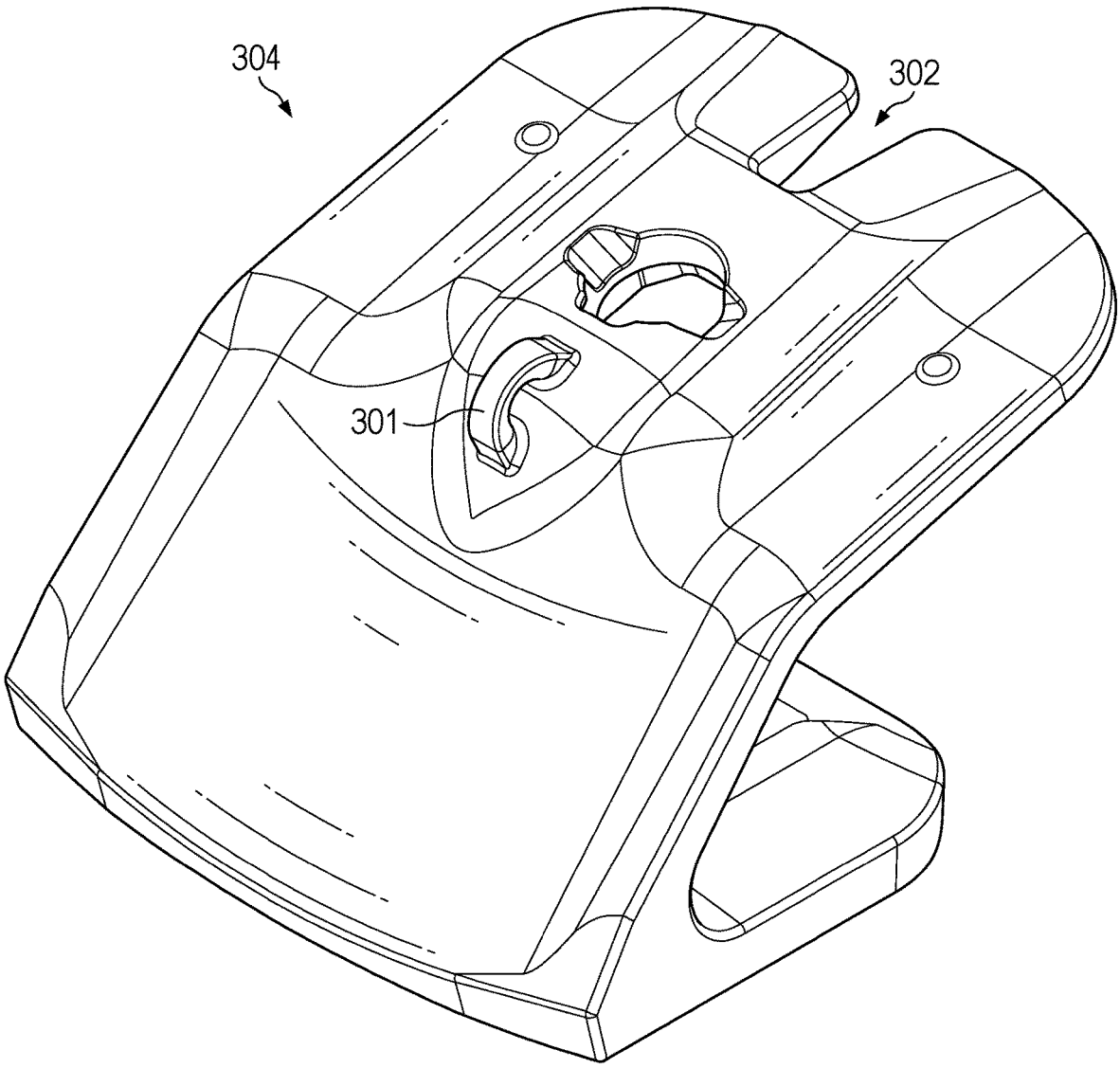
FIGS. 31-33 are perspective views of an example of a shroud according to the present disclosure.
Figure 32:
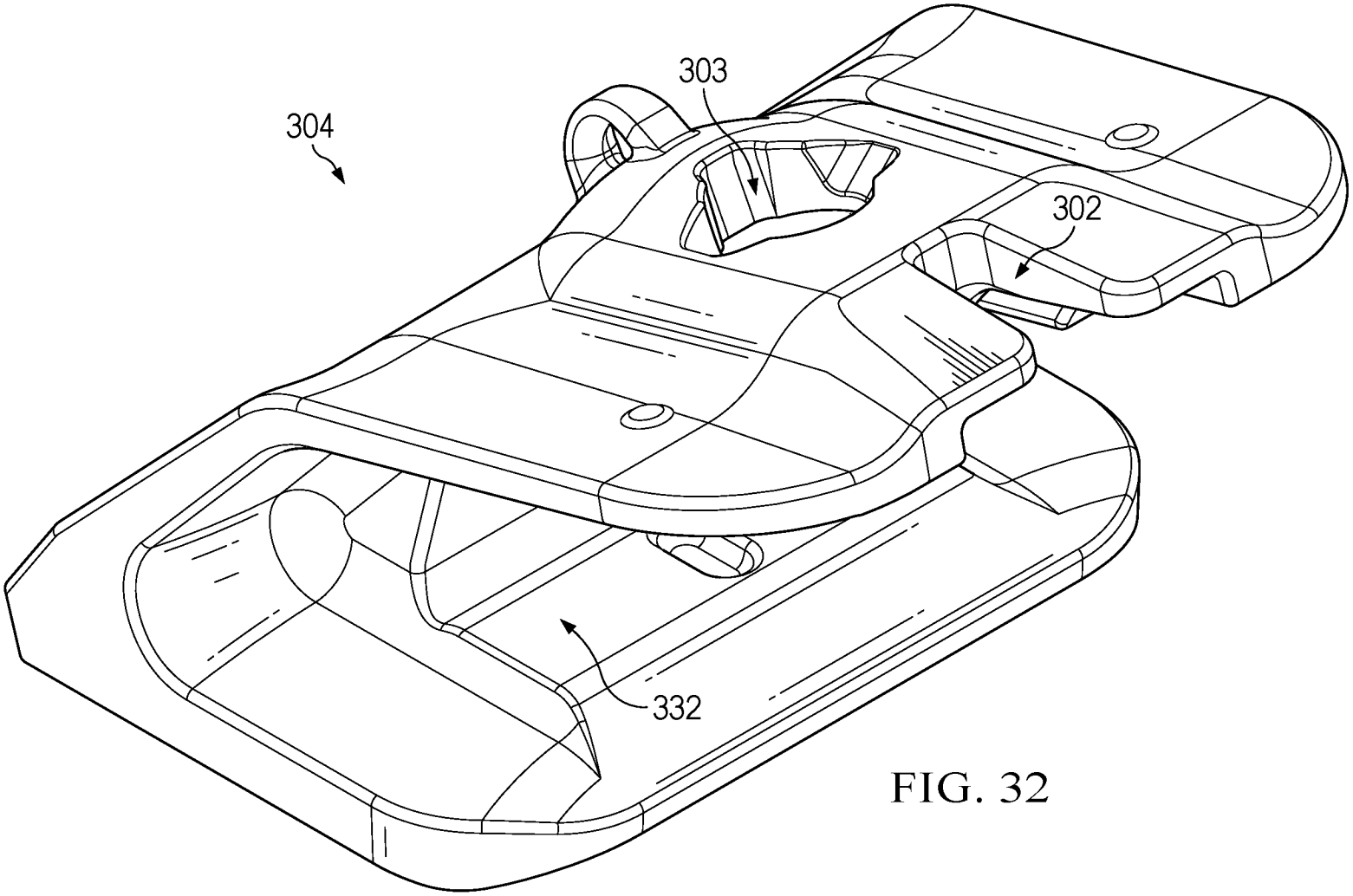
Figure 33:
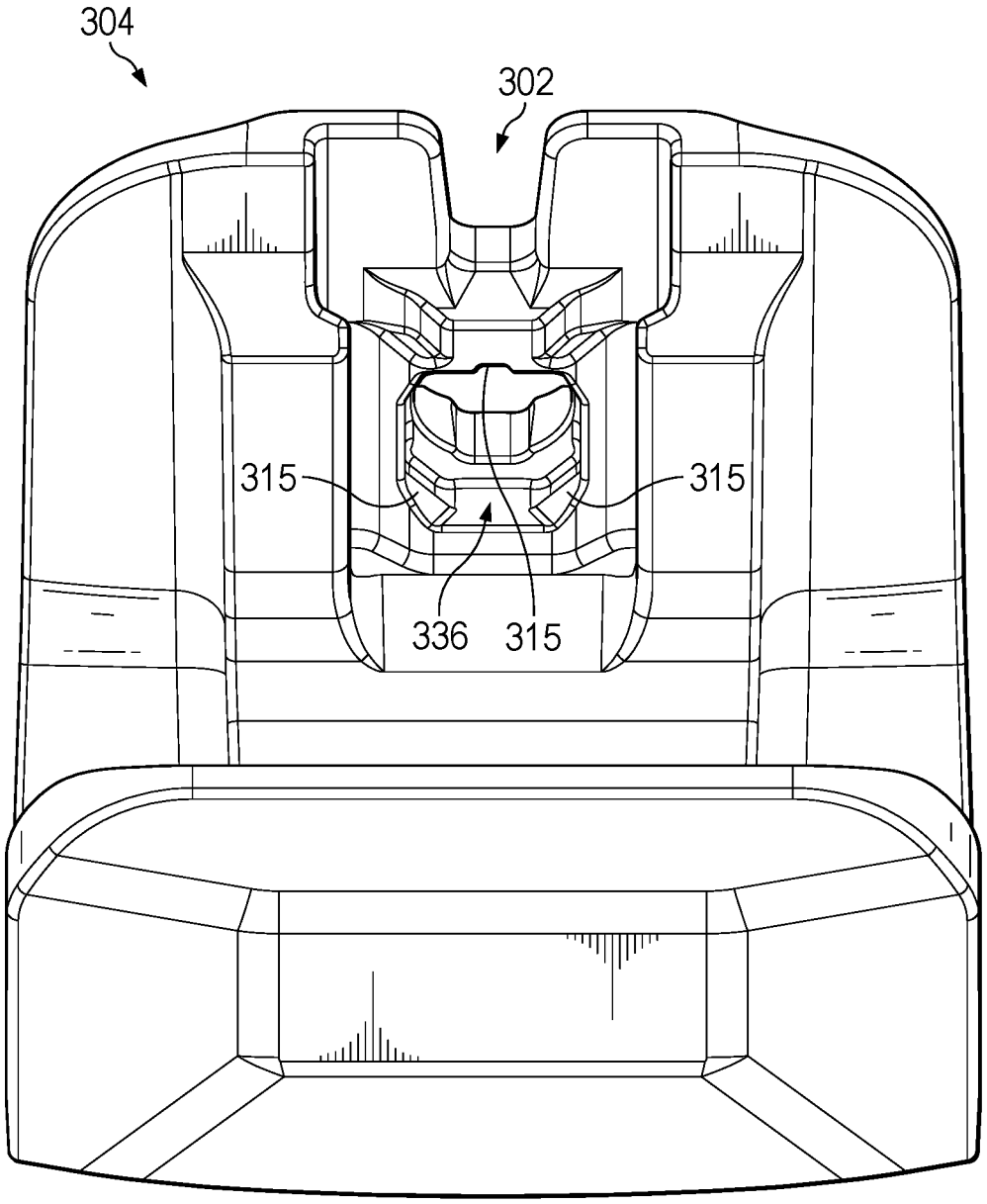

FIGS. 31-37 illustrate further examples of a shroud, a lock assembly including a collar and a pin, etc. for use in the excavation system 100 according to the present disclosure. FIGS. 31-33 illustrate an example of a shroud 304. The shroud 304 has many similarities to shroud 104 and similar features are not repeated in the description of shroud 304 to avoid redundancy. Rather, the description of shroud 304 primarily pertains to additional or different features of shroud 304 as compared to shroud 104. A lifting hook 301 is provided on the top side of the shroud 304 and is configured to receive a hook or other fastener for supporting the shroud during installation and/or removal. A pry channel 302 extends forward from a rear surface of the top leg of the shroud 304. The pry channel 302 may extend a distance equal to approximately 5-30% of the length of the top leg. The pry channel 302 may replace the pry surface 124 of the shroud 104 and may be configured to permit a pry bar or other tool to be inserted into a fixation base recess of the shroud 304 to engage a fixation base for removal of the shroud 304. As compared to shroud 104, the rear surface of shroud 304 may be positioned further rearward, with the top leg overhanging beyond a rear surface of the fixation base, as is appreciated by comparing FIGS. 2 and 37. An alignment window 303 is formed about a portion of the front side of the passage extending through the top leg and permits a user to visually confirm the lock assembly is in the locked configuration, as will be appreciated in view of the discussion of FIGS. 35-36 below. Within the channel between the top and bottom legs is a single rib 332 extending along a top side of the lower leg. The rib has a substantially planar top surface configured to engage or lie adjacent to a bottom surface of a bucket lip when the shroud 104 is installed. A depression is formed in a central portion of the rib 332.

As best seen in FIG. 33, a lock recess 336 configured to receive a collar of a lock assembly is aligned with the passage through the top leg. The lock recess 336 has a peripheral shape corresponding to a shape of a collar, as discussed below in relation to FIG. 34. The lock recess is symmetrical about a plane extending front to rear but is asymmetric about a plane extending side to side. In this regard, the lock recess 336 may prevent installation of a collar of a lock assembly into the lock recess 336 in an incorrect orientation in which the collar is rotated 180° about the axis of the passage through the top leg. Furthermore, the walls forming the lock recess 336 may be tapered (wider on the bottom side of the recess 336 than at the top side of the recess) so the collar cannot be installed in an incorrect orientation in which the collar is rotated 180° about its longitudinal axis.

In the illustrated example, three installation ramps 315 are position about the lock recess 336 in locations corresponding to installation detents of the collar. Specifically, in the illustrated example, two installation ramps 315 are positioned at the front corners of the lock recess 336 and one installation ramp 315 is centered at the rear of the lock recess 336. A pocket is formed into the walls of the lock recess 336 above each installation ramp 315, each pocket extending laterally outward from the lock recess 336 in a direction substantially perpendicular to the respective wall. The pockets are configured to receive an installation detent of the collar.

Figure 34:
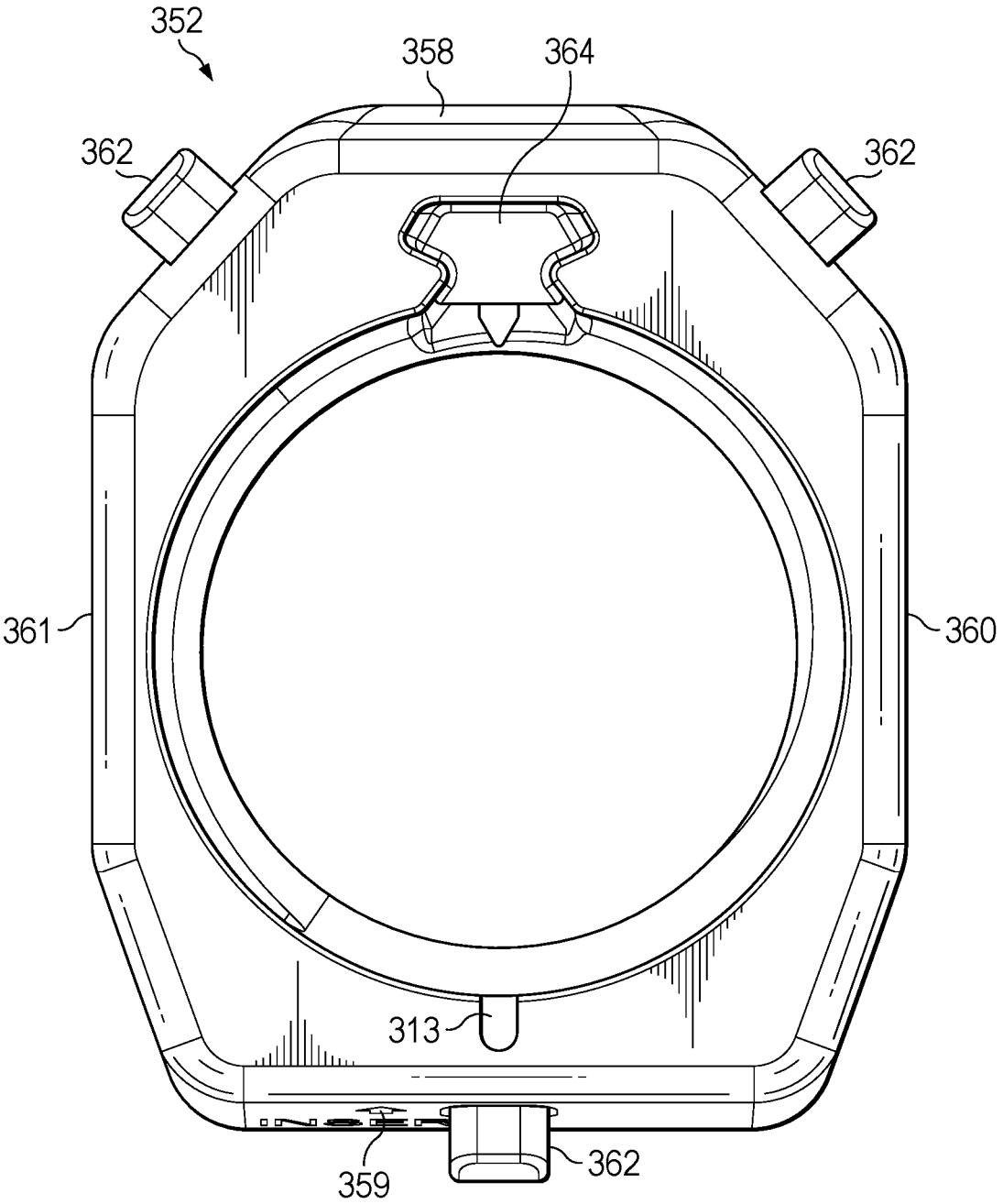
FIG. 34 is a top view of an example of a collar according to the present disclosure.

FIG. 34 illustrates an example of a collar 352 of a lock assembly configured to be received within the lock recess 336. The shroud collar 352 has many similarities to collar 152 and similar features are not repeated in the description of collar 354 to avoid redundancy. Rather, the description of collar 352 primarily pertains to additional or different features of collar 352 as compared to collar 152. Extending between the top surface and the bottom surface are a front side 358, a rear side 359, and opposing side surfaces 360 and 361, each of which may be planar or curved. A pin detent 364 that is biased radially inward is positioned within a correspondingly shaped recess extending radially outward from the bore near the front side 358. The pin detent 364 includes a flexible member having an hourglass shape and a prong extending therefrom. An alignment indicator 313 in the form of a small recess, protrusion, and/or mark (e.g., paint) may be positioned along the longitudinal axis of the collar 352 on the top surface near the rear side 359.

Installation detents 362 that are biased outward from the collar 352 extend from each front corner surface extending between side surfaces 360 and 361 and the front side 358 of the collar 352. Rear corner surfaces extend between the side surfaces 360 and 361 and the rear side 359. Each of the front and rear corner surfaces may be planar or curved. It should be appreciated that chamfering the corners of the collar 352 may help reduce critical stresses in the shroud and/or the collar. Another installation detent 362 extends from the rear side 359. The installation detents 362 may be positioned within correspondingly shaped pockets extending into the collar 352 from the respective outer surface. The collar 352 has a size and shape closely corresponding to the lock recess 336 of the shroud 304.

During use, the collar 352 may be subjected to substantial loading during use of the shroud 304. In this regard, the collar 352 must be sufficiently stout to accommodate the loads without breaking or plastically deforming. In this regard, the collar 352 may have a minimum wall thickness around its perimeter as may be calculated based on design loads and the material used in construction of the collar, e.g., steel. Because the installation detents 362 and pin detent 364 are positioned within recesses or pockets formed into the wall of the collar, those recesses form voids detracting from the thickness of the wall. Accordingly, the collar 352 may have a circumferential profile around the bore that is greater in regions housing the detents 362 and 364 to provide the minimum wall thickness even in those regions. That is, the collar 352 may have a smaller wall thickness about the bore along the sides 360 and 361 where no detents are positioned than near front side 358 and rear side 359.

Figure 35:
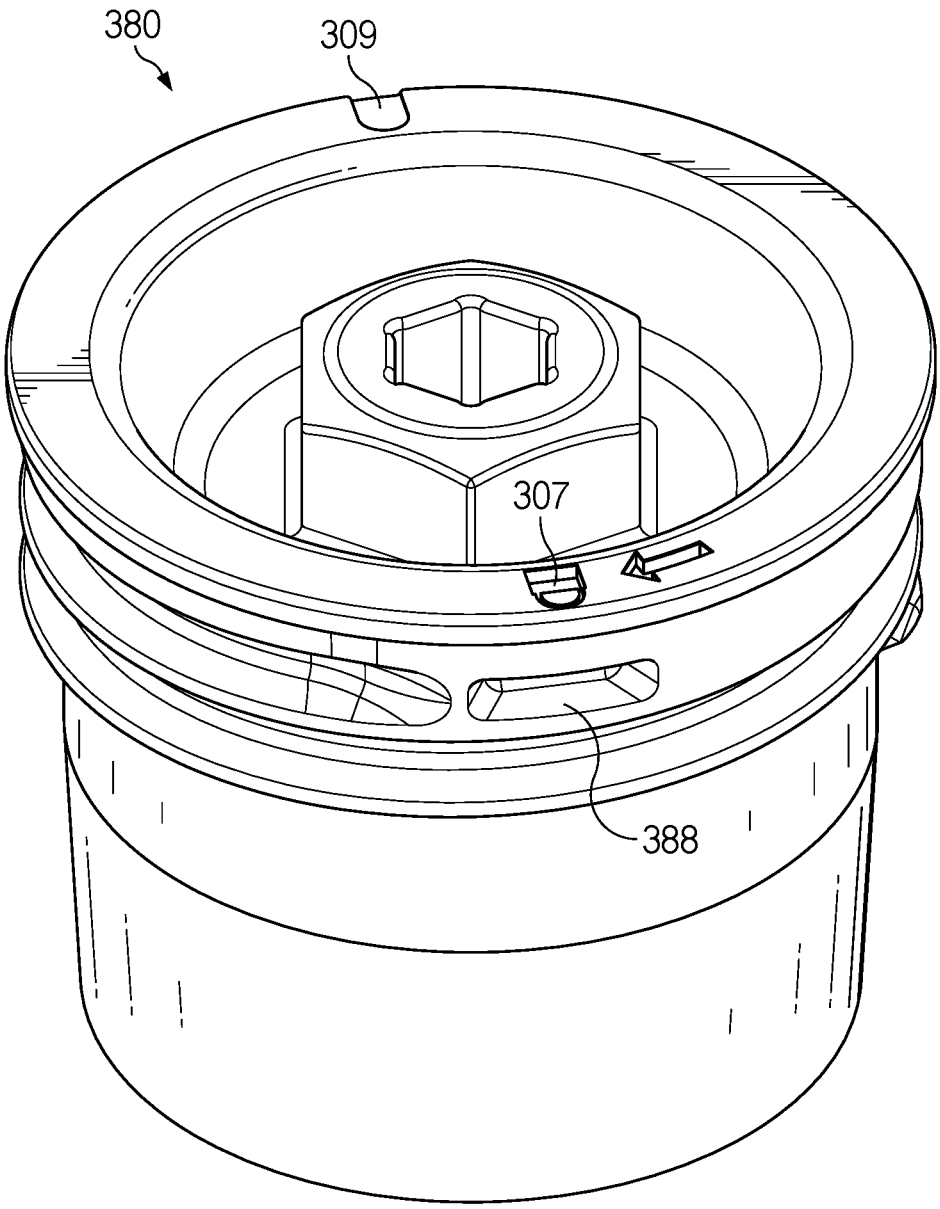
FIG. 35 is a perspective view of an example of a pin according to the present disclosure.

FIG. 35 illustrates a pin 380 of an example of a lock assembly. The pin 380 has many similarities to pin 180 and similar features are not repeated in the description of pin 380 to avoid redundancy. Rather, the description of pin 380 primarily pertains to additional or different features of pin 380 as compared to pin 180. A state indicator 307 and an alignment indicator 309 are formed on the top of the head of the pin 380. The state indicator 307 comprises a lock icon etched into, protruding from, or marked on the top surface of the pin and the alignment indicator 309 is similarly formed at a location separated from the state indicator by 180°, in the illustrated example. Helical threads corresponding to the threads of the collar 352 are formed around the outer circumference of the shaft of the pin 380. An indentation 388 is formed into the shaft at an upper terminal end of the threads. The indentation 388 may be formed along the helical path of the threads and separated from the threads by a ridge extending across the channel of the threads. The indentation 388 may have a size and shape corresponding to the prong of the pin detent 364 of the collar 352. In the illustrated example, the prong 170 and the indentation 188 have a triangular shape. It will be appreciated that in some examples, the pin detent 364 may be housed in the pin 380 and the indentation 388 may be formed within the collar 352.

Figure 36:
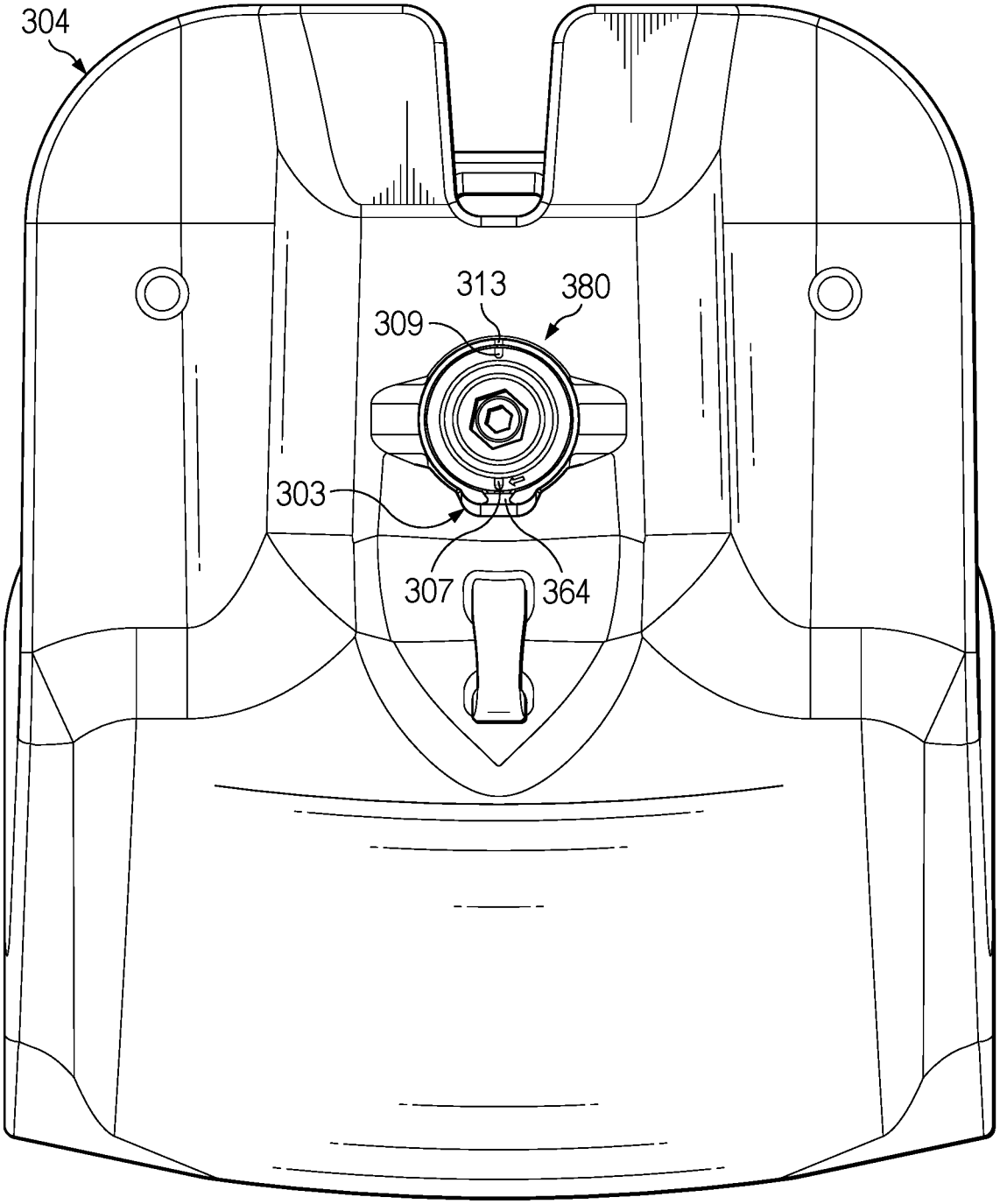
FIGS. 36-37 are a top view and cross-section, respectively, of a lip shroud assembly according to an example of the present disclosure.
Figure 37:
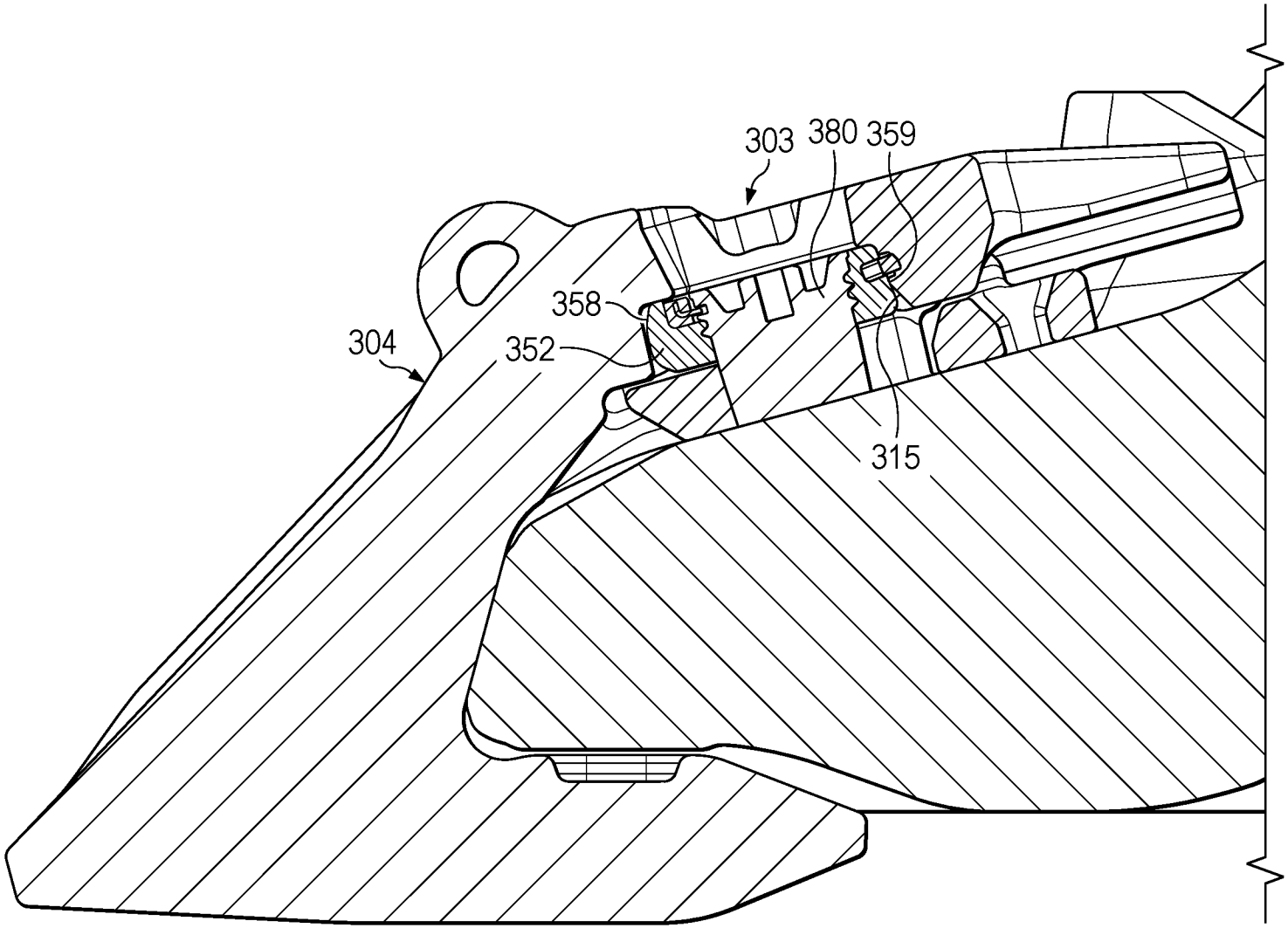

FIGS. 36-37 illustrate the shroud and lock assembly in an assembled configuration. In the locked configuration shown in FIG. 36, the alignment window 303 in the shroud 304 allows a user to visually inspect that the pin detent 364 is aligned with the state indicator 307, thereby confirming the pin 380 is locked with respect to the collar 352. Similarly, the alignment indicators 309 and 313 may be visible near the rear of the bore. As seen in FIG. 37, one or more of the outer surfaces of the collar 352 may be tapered or otherwise angled with respect to the top surface and/or bottom surface of the collar. For example, the rear side 359 of the collar 352 is angled outward from the top surface toward the bottom surface. The front side 358 may similarly have one or more portions angled outward from the top surface to the bottom surface. The side surfaces 360 and 361 of the collar may be vertical or may be angled outward.

Persons of ordinary skill in the art will appreciate that the implementations encompassed by the present disclosure are not limited to the particular exemplary implementations described above. In that regard, although illustrative implementations have been shown and described, a wide range of modification, change, combination, and substitution is contemplated in the foregoing disclosure. It is understood that such variations may be made to the foregoing without departing from the scope of the present disclosure. For example, features of the example shroud and lock assembly of FIGS. 31-37 may be implemented in the examples described in relation to FIGS. 1-30, and vice versa. Accordingly, it is appropriate that the appended claims be construed broadly and in a manner consistent with the present disclosure.

Examples of a lock assembly are described below:

Example 1. A lock assembly for securing a wear member to a support structure, comprising: a collar comprising: a top surface; a bottom surface opposite the top surface; a bore extending along a central axis from the top surface to the bottom surface, the collar having an irregular outer circumferential profile about the central axis including a plurality of curved surfaces extending between adjacent sides of the collar; and a pin configured for receipt in the bore of the collar.

Example 2. The lock assembly of example 1, wherein at least a portion of a wall defining the bore of the collar includes first threads and at least a portion of an outer surface of the pin includes second threads corresponding to the first threads.

Example 3. The lock assembly of example 2, wherein the collar further comprises a biased pin detent mechanism, a portion of the pin detent mechanism extending into the bore, and the pin comprises an indentation adjacent to an upper end of the second threads that is configured to receive the portion of the pin detent mechanism when the pin is fully seated in the collar.

Example 4. The lock assembly of example 3, wherein the pin detent mechanism comprises a flexible member and a rigid member secured to the flexible member.

Example 5. The lock assembly of example 4, wherein the collar comprises a recess extending radially outward from the bore and axially inward from the top surface.

Example 6. The lock assembly of example 5, wherein the recess is wedge-shaped with a narrower width at a front side adjacent to the bore and a greater width at a rear side opposite the bore, and wherein the flexible member of the pin detent mechanism has a shape corresponding to the recess.

Example 7. The lock assembly of example 3, wherein the portion of the pin detent mechanism is configured to pass through a channel formed in the second threads of the pin as the pin is rotated with respect to the collar.

Example 8. The lock assembly of example 2, wherein a top surface of the pin is substantially flush with or recessed below the top surface of the collar when the pin is fully seated in the collar.

Example 9. The lock assembly of example 1, further comprising: a first biased detent mechanism extending outward from a first lateral side of the collar; and a second biased detent mechanism extending outward from a second lateral side of the collar.

Example 10. The lock assembly of example 9, wherein the first biased detent mechanism is disposed adjacent a first end of the collar and the second biased detent mechanism is disposed adjacent a second end of the collar.

Example 11. The lock assembly of example 1, wherein the irregular outer circumferential profile of the collar is defined by a plurality of minor arcs each having a radius of curvature different than each other minor arc of the plurality of minor arcs.

Example 12. The lock assembly of example 1, wherein the irregular outer circumferential profile of the collar is asymmetric about any plane parallel to the central axis.

Example 13. The lock assembly of example 1, wherein a rear surface extending between the top surface and the bottom surface and defining a rear side of the collar is angled with respect to the central axis of the bore.

Example 14. The lock assembly of example 13, wherein the rear surface of the collar is angled away from the central axis toward the bottom surface of the collar at approximately 1-20° with respect to the central axis of the bore.

Example 15. The lock assembly of example 1, wherein a front side of the collar and a rear side of the collar are tapered toward the central axis of the bore in a direction extending from the bottom surface to the top surface.

Example 16. The lock assembly of example 1, wherein a head of the pin includes a post having a hexagonal outer profile.

Example 17. The lock assembly of example 16, wherein a hexagonal recess is formed into the post.

Example 18. The lock assembly of example 1, wherein the pin comprises a shaft that narrows toward a tip of the pin disposed opposite a head of the pin.

Example 19. The lock assembly of example 18, wherein the shaft has an outer surface that is angled at approximately 1-10° with respect to a central axis of the pin.

Example 20. The lock assembly of example 18, wherein an upper portion of the shaft is cylindrical and threaded and a lower portion of the shaft is angled with respect to a central axis of the pin.

What is claimed is:

1. A lock assembly for securing a wear member to a support structure, comprising:

a collar comprising:

a top surface;

a bottom surface opposite the top surface;

an outer circumferential profile including at least eight planar surfaces extending around a perimeter of the collar between the top and bottom surfaces;

a bore extending along a central axis from the top surface to the bottom surface; and a pin configured for receipt in the bore of the collar, wherein at least a portion of a wall defining the bore of the collar includes first threads and at least a portion of an outer surface of the pin includes second threads corresponding to the first threads, and wherein the collar further comprises a biased pin detent mechanism, a portion of the pin detent mechanism extending into the bore, and the pin comprises an indentation adjacent to an upper end of the second threads that is configured to receive the portion of the pin detent mechanism when the pin is fully seated in the collar.

2. The lock assembly of claim 1, wherein a front side of the collar and a rear side of the collar are tapered toward the central axis of the bore in a direction extending from the bottom surface to the top surface.

3. The lock assembly of claim 1, wherein the pin comprises a shaft that narrows toward a tip of the pin disposed opposite a head of the pin.

4. The lock assembly of claim 1, wherein the pin detent mechanism comprises a flexible member and a rigid member secured to the flexible member.

5. The lock assembly of claim 4, wherein the collar comprises a recess extending radially outward from the bore and axially inward from the top surface.

6. The lock assembly of claim 1, wherein the outer circumferential profile of the collar is defined at least in part by a front surface, a rear surface, opposing side surfaces, and four corner surfaces.

7. The lock assembly of claim 1, wherein the outer circumferential profile of the collar is laterally symmetrical about a plane extending from a front side of the collar to a rear side of the collar and extending between the top and bottom surfaces.

8. The lock assembly of claim 1, wherein a rear surface extending between the top surface and the bottom surface and defining a rear side of the collar is angled with respect to the central axis of the bore.

9. The lock assembly of claim 1, further comprising:

a first biased detent mechanism extending outward from a first front corner surface of the collar; and a second biased detent mechanism extending outward from a second front corner surface of the collar.

10. The lock assembly of claim 9, further comprising a third biased detent mechanism extending outward from a rear surface of the collar.

11. A lock assembly for securing a wear member to a support structure, comprising:

a collar comprising:

a top surface;

a bottom surface opposite the top surface;

an outer circumferential profile including at least eight planar surfaces extending around a perimeter of the collar between the top and bottom surfaces;

a bore extending along a central axis from the top surface to the bottom surface; and a pin configured for receipt in the bore of the collar, wherein at least a portion of a wall defining the bore of the collar includes first threads and at least a portion of an outer surface of the pin includes second threads corresponding to the first threads, and wherein a top surface of the pin is substantially flush with or recessed below the top surface of the collar when the pin is fully seated in the collar.

12. The lock assembly of claim 11, further comprising:

a first biased detent mechanism extending outward from a first front corner surface of the collar; and a second biased detent mechanism extending outward from a second front corner surface of the collar.

13. The lock assembly of claim 12, further comprising a third biased detent mechanism extending outward from a rear surface of the collar.

14. The lock assembly of claim 11, wherein the outer circumferential profile of the collar is defined at least in part by a front surface, a rear surface, opposing side surfaces, and four corner surfaces.

15. The lock assembly of claim 11, wherein the outer circumferential profile of the collar is laterally symmetrical about a plane extending from a front side of the collar to a rear side of the collar and extending between the top and bottom surfaces.

16. The lock assembly of claim 11, wherein a rear surface extending between the top surface and the bottom surface and defining a rear side of the collar is angled with respect to the central axis of the bore.

17. The lock assembly of claim 11, wherein a front side of the collar and a rear side of the collar are tapered toward the central axis of the bore in a direction extending from the bottom surface to the top surface.

18. The lock assembly of claim 11, wherein the pin comprises a shaft that narrows toward a tip of the pin disposed opposite a head of the pin.

* * * * *